US005941106A

United States Patent [19]

Williamson, Jr. et al.

[11] Patent Number: 5,941,106

[45] **Date of Patent: *Aug. 24, 1999**

[54] ELECTRONIC REMOTE CONTROLLED LOCK

[75] Inventors: Richard H. Williamson, Jr., Fort Worth; James H. Gordon, Arlington, both of Tex.

[73] Assignee: Northwind Industries, Inc., Fort Worth, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 08/589,348

[22] Filed: Jan. 22, 1996

Related U.S. Application Data

[63] Continuation-in-part of application No. 08/296,518, Aug. 26, 1994, abandoned.

[51] Int. Cl.[6] ..... E05B 47/02

[52] U.S. Cl. ..... 70/278.1; 70/280; 292/144; 361/166

[58] Field of Search ..... 292/144; 70/280, 70/277, 278.1, 278.2, 278.3, 278.4, 278.5, 278.6, 278.7, 281, 282, 283.1; 361/166, 167, 168.1, 189, 191

[56] References Cited

U.S. PATENT DOCUMENTS

| | | | |
|---|---|---|---|
| 1,085,347 | 1/1914 | Leduc | 292/144 |
| 2,156,387 | 5/1939 | Goldfinger | 292/144 |
| 3,242,708 | 3/1966 | Sanchez . | |
| 3,309,664 | 3/1967 | Deutsch et al. | 292/144 X |
| 3,627,960 | 12/1971 | Grabek | 292/144 X |
| 3,641,396 | 2/1972 | Kossen et al. | 317/134 |
| 3,751,086 | 8/1973 | Geringer | 292/144 |
| 3,798,398 | 3/1974 | Hills | 70/429 |
| 3,876,913 | 4/1975 | Perry | 317/134 |
| 3,879,709 | 4/1975 | Yukawa | 340/171 R |
| 3,933,382 | 1/1976 | Counts et al. | 292/144 |
| 3,996,591 | 12/1976 | Hayward | 343/225 |
| 4,083,424 | 4/1978 | von den Stemmen et al. | 180/114 |
| 4,132,439 | 1/1979 | Millar | 70/279 X |
| 4,573,046 | 2/1986 | Pinnow | 340/825.56 |
| 4,663,621 | 5/1987 | Field et al. | 340/825.31 |
| 4,808,995 | 2/1989 | Clark et al. | 340/825.69 |
| 4,848,115 | 7/1989 | Clarkson et al. | 70/278 X |
| 4,917,419 | 4/1990 | Mora, Jr. et al. | 292/144 |
| 4,967,305 | 10/1990 | Murrer et al. | 361/172 |
| 4,978,816 | 12/1990 | Castonguay et al. | 70/DIG. 30 X |
| 4,986,099 | 1/1991 | Johnson et al. | 292/144 X |
| 5,021,776 | 6/1991 | Anderson et al. | 340/825.31 |
| 5,083,122 | 1/1992 | Clark | 340/825.32 |
| 5,219,386 | 6/1993 | Kletzmaier et al. | 70/277 |
| 5,225,825 | 7/1993 | Warren | 340/825.31 |
| 5,261,260 | 11/1993 | Lin | 70/280 |
| 5,263,347 | 11/1993 | Allbaugh et al. | 70/257 |
| 5,314,243 | 5/1994 | McDonald et al. | 312/215 |
| 5,347,267 | 9/1994 | Murray | 340/825.31 |
| 5,359,322 | 10/1994 | Murray | 340/825.31 |
| 5,421,178 | 6/1995 | Hamel et al. | 70/283 |
| 5,487,290 | 1/1996 | Miller et al. | 292/144 X |
| 5,555,752 | 9/1996 | Fitzpatrick | 70/DIG. 30 X |

FOREIGN PATENT DOCUMENTS

| | | | |
|---|---|---|---|
| 808067 | 3/1969 | Canada | 292/144 |
| 456440 | 6/1913 | France | 292/144 |
| 935432 | 2/1948 | France | 292/144 |
| 2504774 | 8/1975 | Germany | 292/144 |

*Primary Examiner*—Lloyd A. Gall
*Attorney, Agent, or Firm*—James E. Bradley

[57] ABSTRACT

An electrical circuit that includes a ferrous plunger operated by electrical coils and pulses current. One end of the plunger extends and retracts into contact with an adjustable latch such that only one moving part is required and only a small amount of electrical energy. Selectively activating the coils throws the plunger between the locked and unlocked positions. The circuit includes provisions to open the lock in the event of power failure. The plunger mechanism is mounted on an easily installed housing that, with the latch mechanism, has hardware for accurate alignment and installation. In one embodiment, a series of plungers can be operated by a wireless remote-control device. In another embodiment, the series of plungers can be operated by a switch mounted on a wall. In yet another embodiment, the series of plungers can be operated only after entering a four digit code into a programable key pad unit.

14 Claims, 20 Drawing Sheets

ELECTRONIC REMOTE CONTROLLED LOCK

CROSS REFERENCE TO RELATED APPLICATION

This is a continuation-in-part of a previous application for patent, Ser. No. 296,518, filed Aug. 26, 1994, abandoned Sep. 23, 1996, and entitled "Electronic Remote Controlled Lock".

BACKGROUND OF THE INVENTION

1. Field of the Invention

This invention relates to electronic remote controlled locks, especially to those useful for locking otherwise conventional cabinets and desks in homes and commercial establishments.

2. Background

There is a long standing need for a locking system that can be conveniently and inexpensively installed on the cabinet doors and drawers of homes to limit access by children and the impaired to toxic chemicals and dangerous pharmaceuticals. "Children from birth to three make up the highest risk group for injuries in the home". Parents' Magazine, September 1990, v. 65, n. 9, p111. The National Safety Council reported that during the year 1988 poisoning was one of the five leading causes of accidental home deaths for children under five. According to the American Association of Poison Control Centers, children were the victims of over sixty percent of the 1.3 million nonfatal poisonings reported in 1988.

It would be advantageous to have remotely controlled, individual locks that are universally designed to install in extremely confined areas such as drawers, cabinets and all types of enclosures. Remote control is advantageous because many cabinets and drawers contain potentially dangerous substances and chemicals, which are usually located in different areas of the home, including the kitchen, bathrooms, utility room and garage. The remote and instantaneous locking of all these widely dispersed and selected enclosures would enhance safety and minimize the chances for chemically and pharmaceutically induced human injury. The convenience of remote controlled locking would encourage the use of locking devices, or at least will not limit use, because of oversight of one or more enclosure.

A need also exists in offices, other commercial establishments and in homes for a remote control locking device for cabinets and desk drawers to secure or at least limit access to valuable items and documents from intruders and unauthorized observers. It is too inconvenient to lock each desk, cabinet or storage area individually, especially when time is pressing or emergencies arise.

The prior art locking devices seem to fall into two categories: (1) those that operate individually and (2) those that operate remotely but in a mode that limits usefulness and applicability because of a burdensome installation cost or difficult installation.

The individually operated locks include those using keys and combination tumblers. Also included is the type of lock that is actuated by a permanent magnet that trips a lock inside a cabinet or drawer when held adjacent the exterior of the cabinet or drawer and adjacent the lock.

The remotely controlled locks include those that are connected electrically to a switch that is manually or timer controlled, such as those used to secure bank vaults. There are also radio controlled locks such as those used to unlock automobile trunk lids and doors by operation of a small radio frequency transmitted carried on a key ring by a motorist. The transmitter is programmable to send a coded signal, and the receivers for the radio controlled locks have a decoder for enhanced security.

The known prior art locking devices have not been applied, or have received little acceptance as remote controlled locking devices and systems for the enclosures of homes or offices, possibly because they are in general too expensive, or inconvenient to install or use, require too much energy or are physically too large to install in these confined areas. For whatever reason, the failure to provide a remotely controlled locking system that can be easily and economically applied to otherwise ordinary doors and drawers, especially in households, has left too many children in harm's way.

SUMMARY OF THE INVENTION

It is the general object of the invention to provide homes and offices with an electrically operated remote controlled lock that is easily and economically installed on a door or drawer to prevent access by unauthorized personnel. The lock may be used to protect unauthorized humans, especially children, from hazardous substances, such as the cleaning chemicals kept under the sink in a home. The lock operates on a small voltage that protects humans from exposure to the high voltages and currents commonly used in municipal power supplies.

The above as well as additional objects, features and advantages are achieved with an electrical circuit that includes a ferrous plunger operated by electrical coils and pulses of current. One end of the plunger extends and retracts into contact with an adjustable latch such that only one moving part is required and only a small amount of pulsed electrical energy. The selective activation of the coils positions the plunger between the locked and unlocked positions. The plunger mechanism is mounted on an easily installed housing that, with the latch mechanism, has means for accurate and convenient alignment. The latch mechanism has an extensible and retractable tongue, with striations and fasteners to enable convenient and accurate positioning and installation opposite the lock housing. The plunger serves as a dead bolt lock to engage and disengage a detent in the tongue. In one embodiment, a series of plungers can be operated by a wireless remote-control device. In another embodiment, the series of plungers can be operated by a switch mounted on a wall. In yet another embodiment, the plungers can be operated only after entering a four digit code into a programable key pad unit.

The above as well as additional objects, features and advantages of the invention will become apparent in the following description.

Also shown is the alignment rack used to align the ferrous plunger and an adjustable latch.

Figure 5:
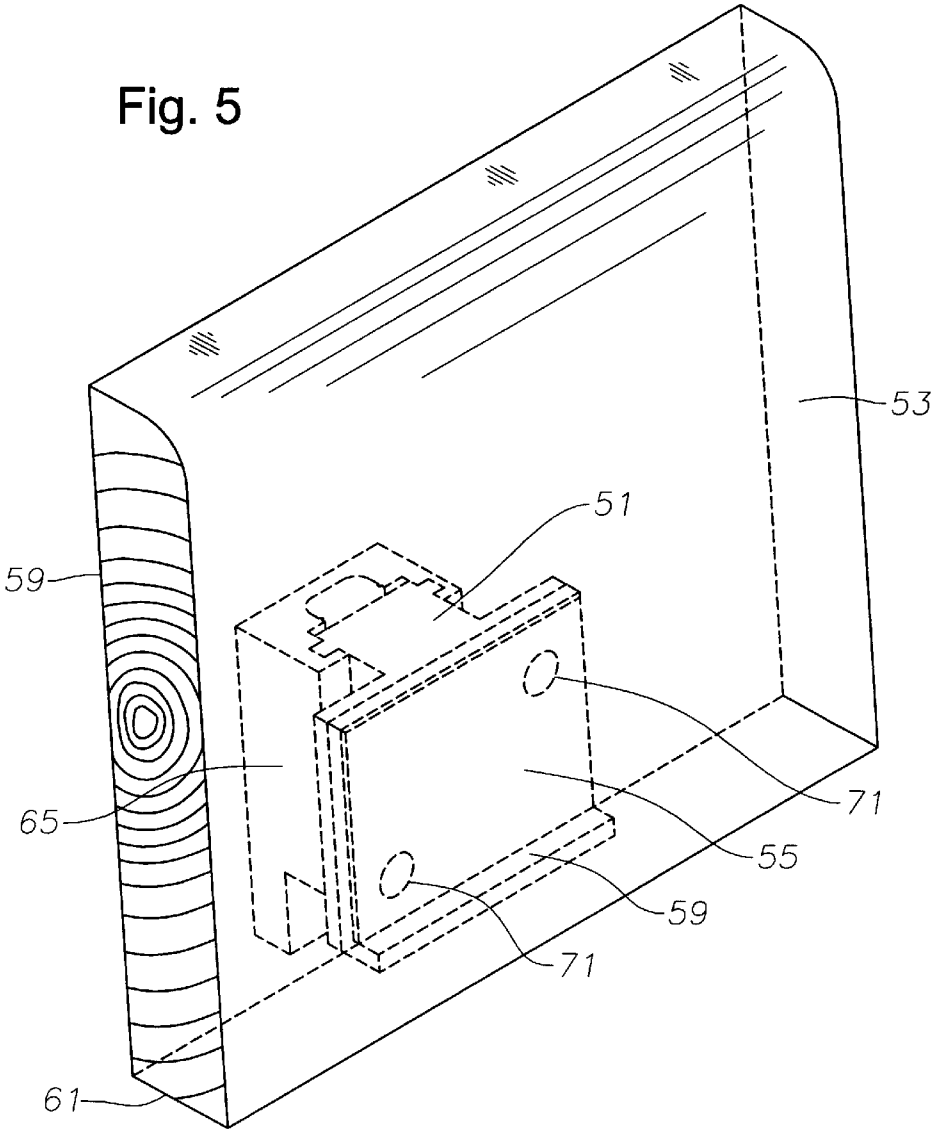

FIG. 5 is a perspective view of a part of an enclosure, such as the header of a household cabinet, and the main lock housing and alignment rack shown inside the closure in an assembled position.

Figure 6:
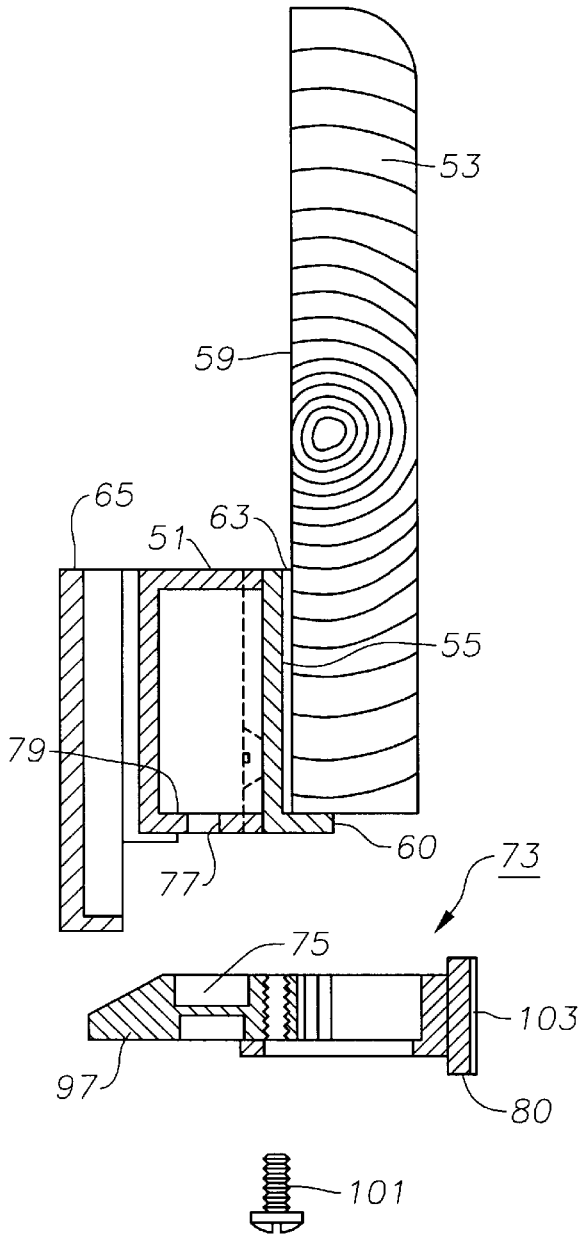

FIG. 6 is a side view in section of the header and housing of FIG. 5 and of an adjustable latch mechanism in a position immediately before assembly.

Figure 7:
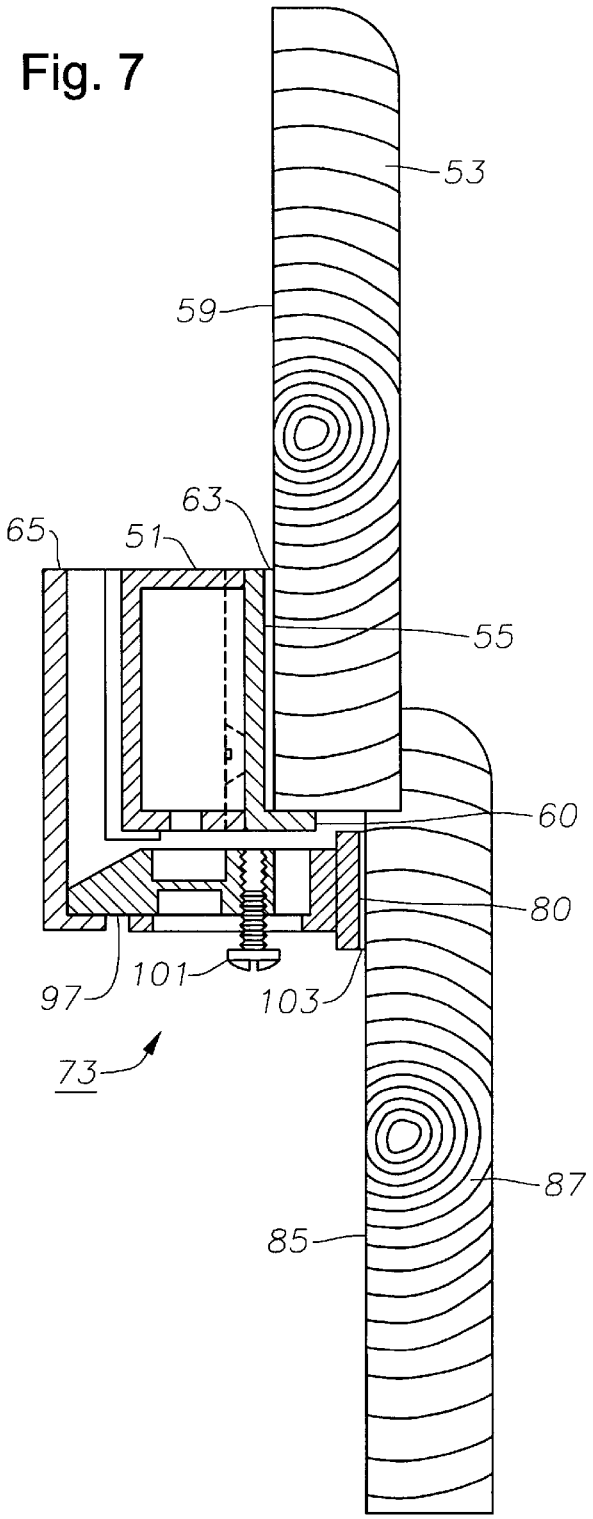

FIG. 7 is a side view in section of the FIG. 6 apparatus, also showing a portion of the closure, here a door, against the header and the latch mechanism position by the alignment rack.

Figure 8:
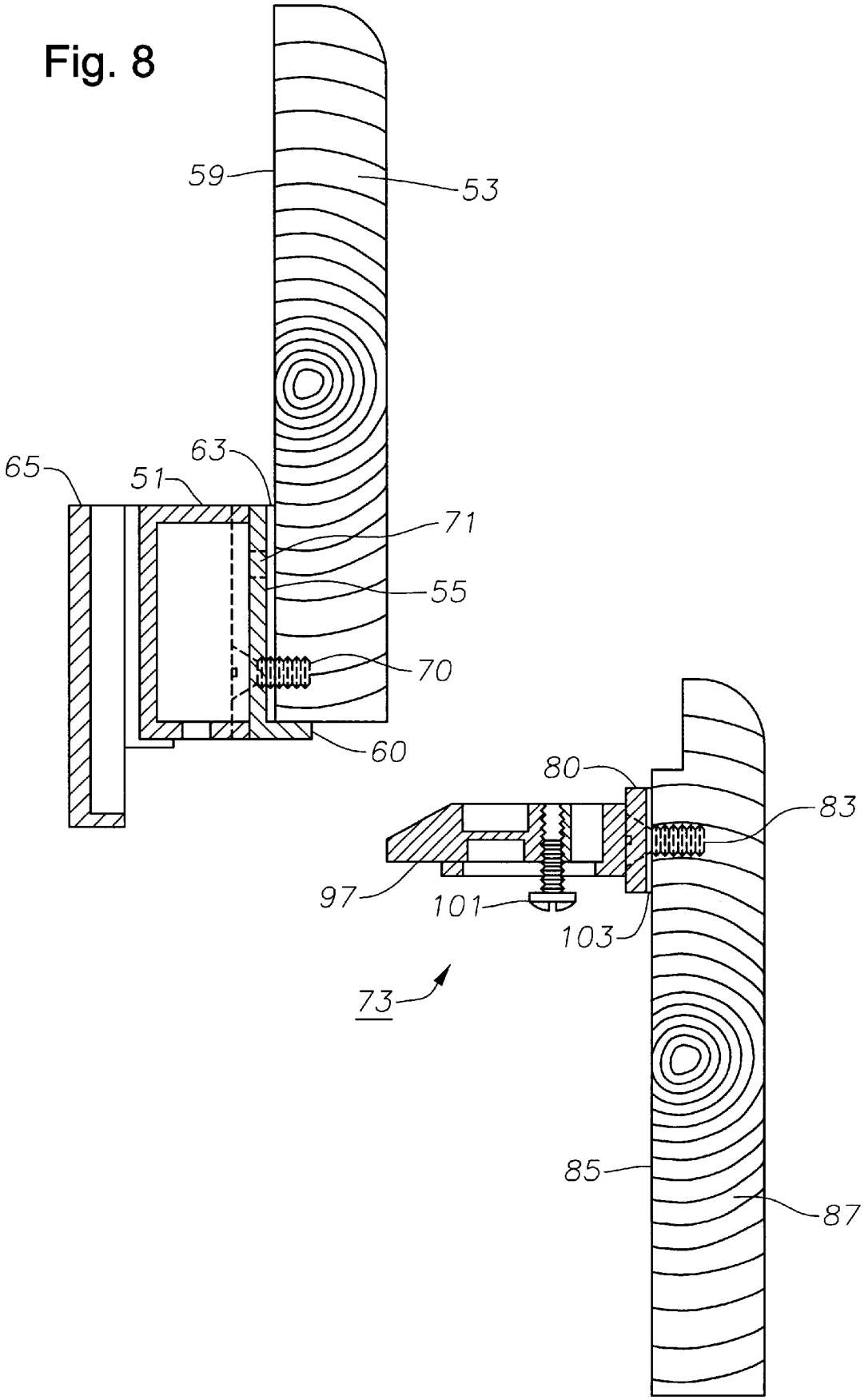

FIG. 8 is a side view in section of the FIG. 7 apparatus, with the housing and latch assembly in the final position, the door shown in an open position.

Figure 9:
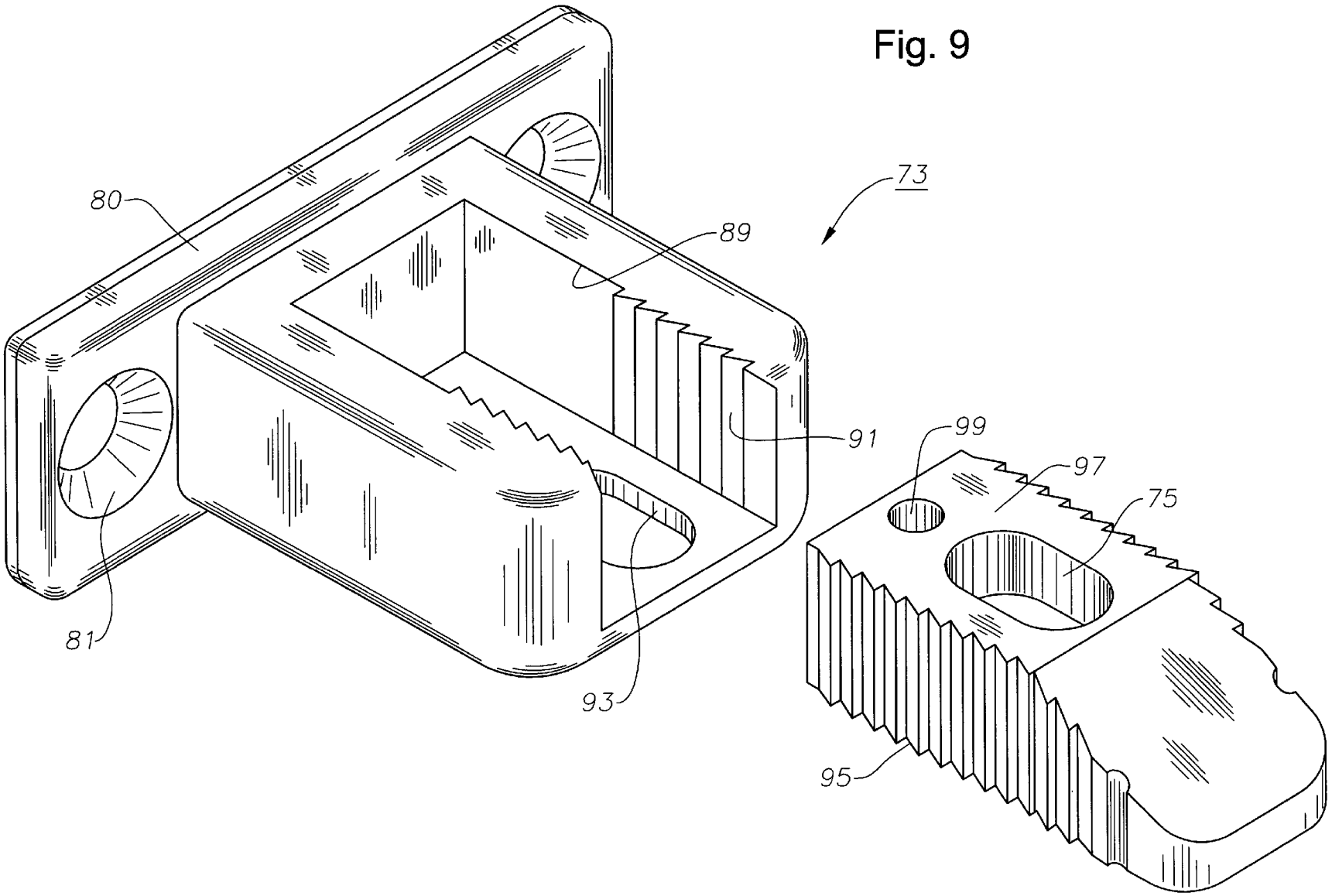
Figure 10:
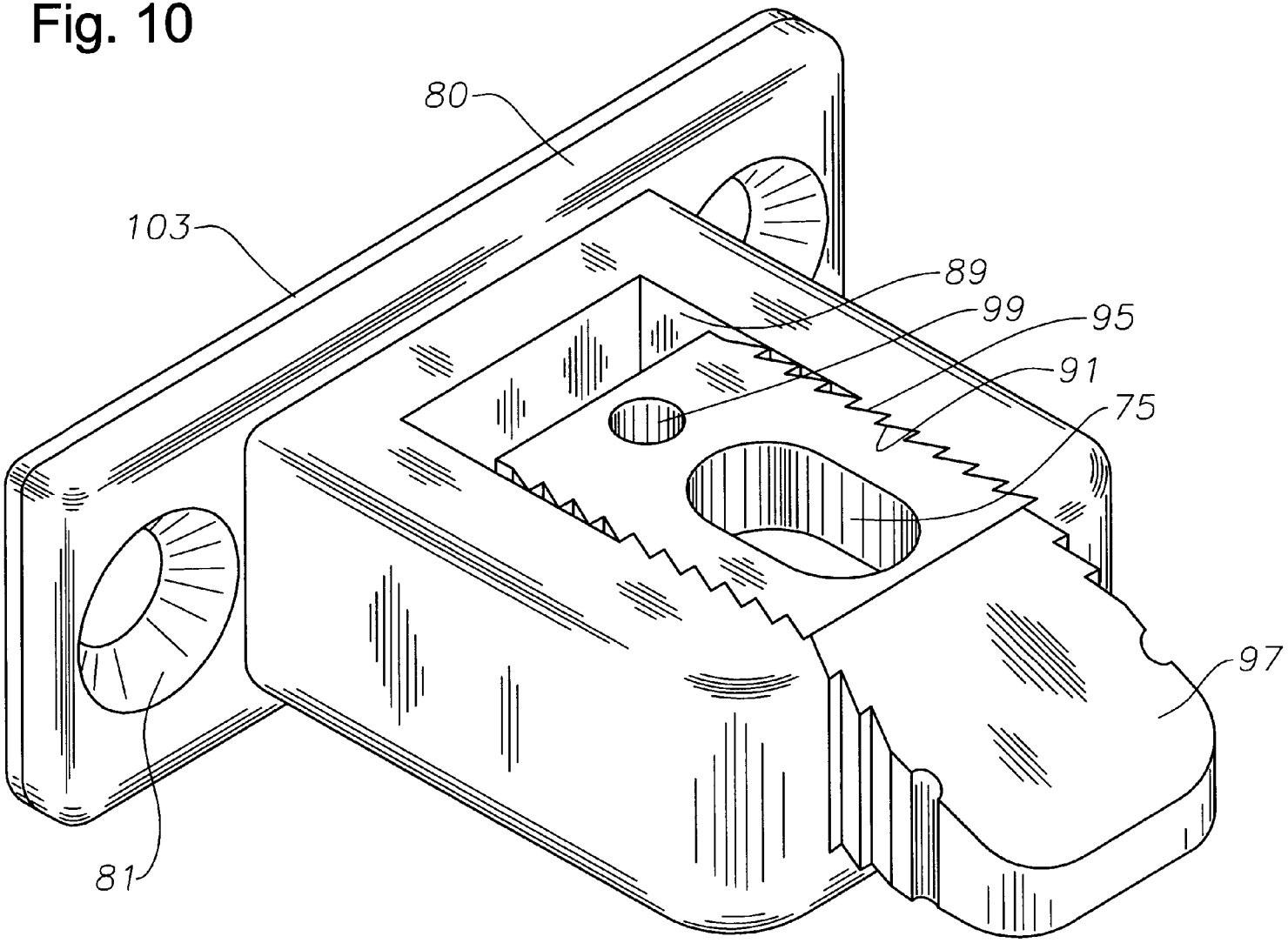

FIG. 9 is a perspective view of the latch assembly of FIG. 10 with the tongue separated to reveal details of construction.

FIG. 10 is a perspective view of the latch assembly of FIG. 9, with the tongue in an assembled position.

Figure 11:
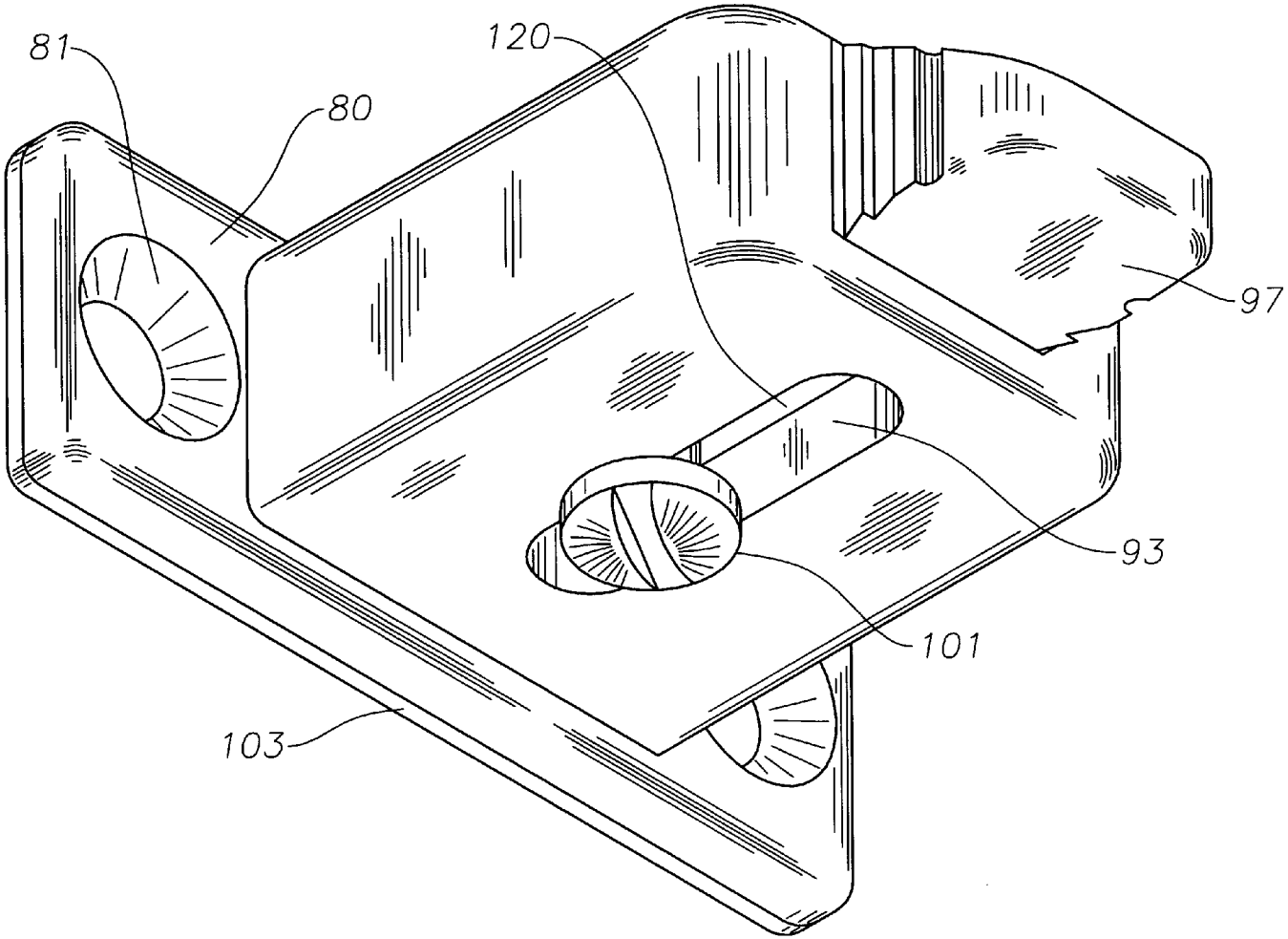

FIG. 11 is a perspective view from the bottom of the latch assembly, showing the tongue in the final, fastened assembly position.

Figure 12:
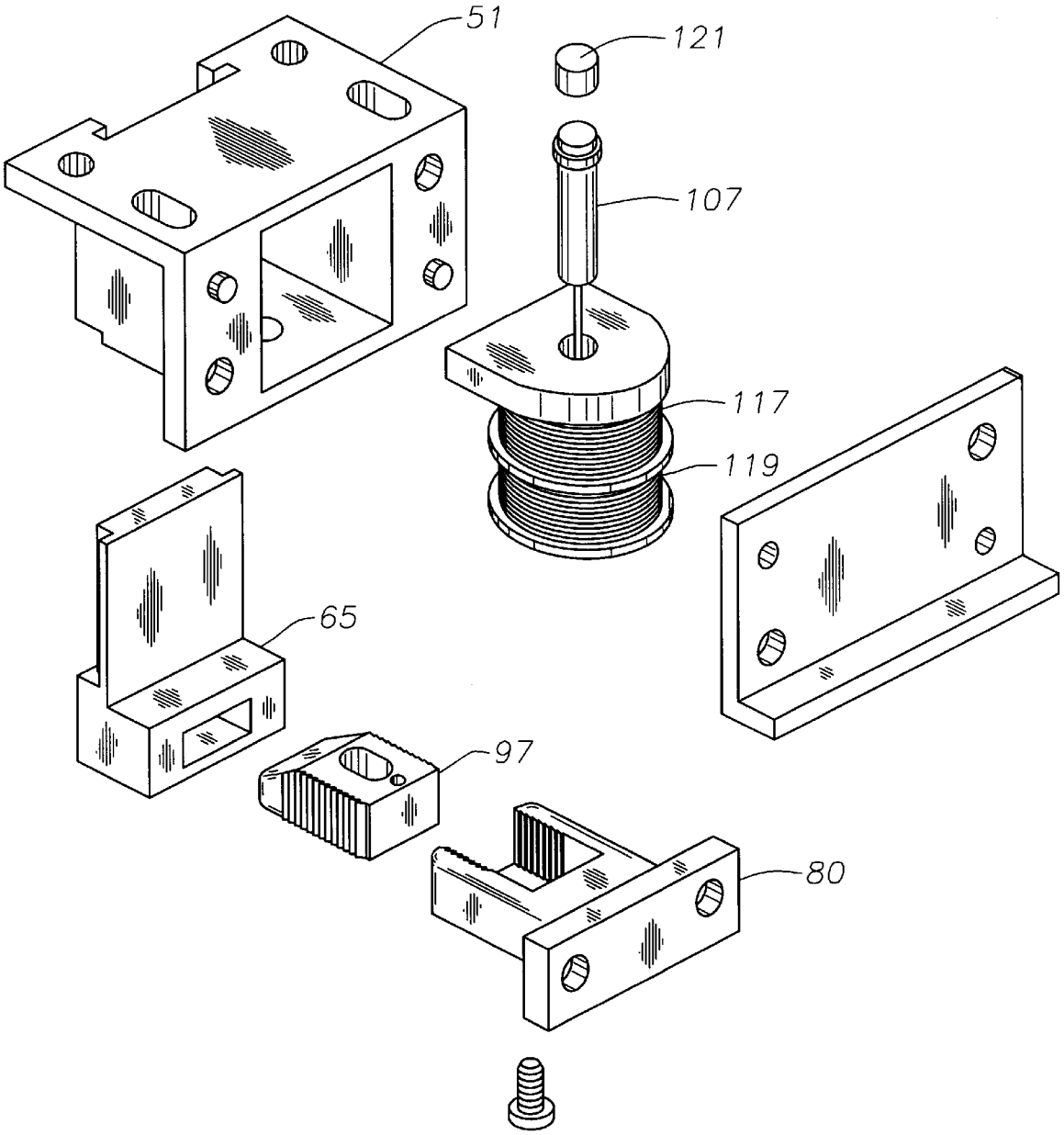

FIG. 12 is an exploded view showing the principal components of the lock and the latch assembly.

Figure 13:
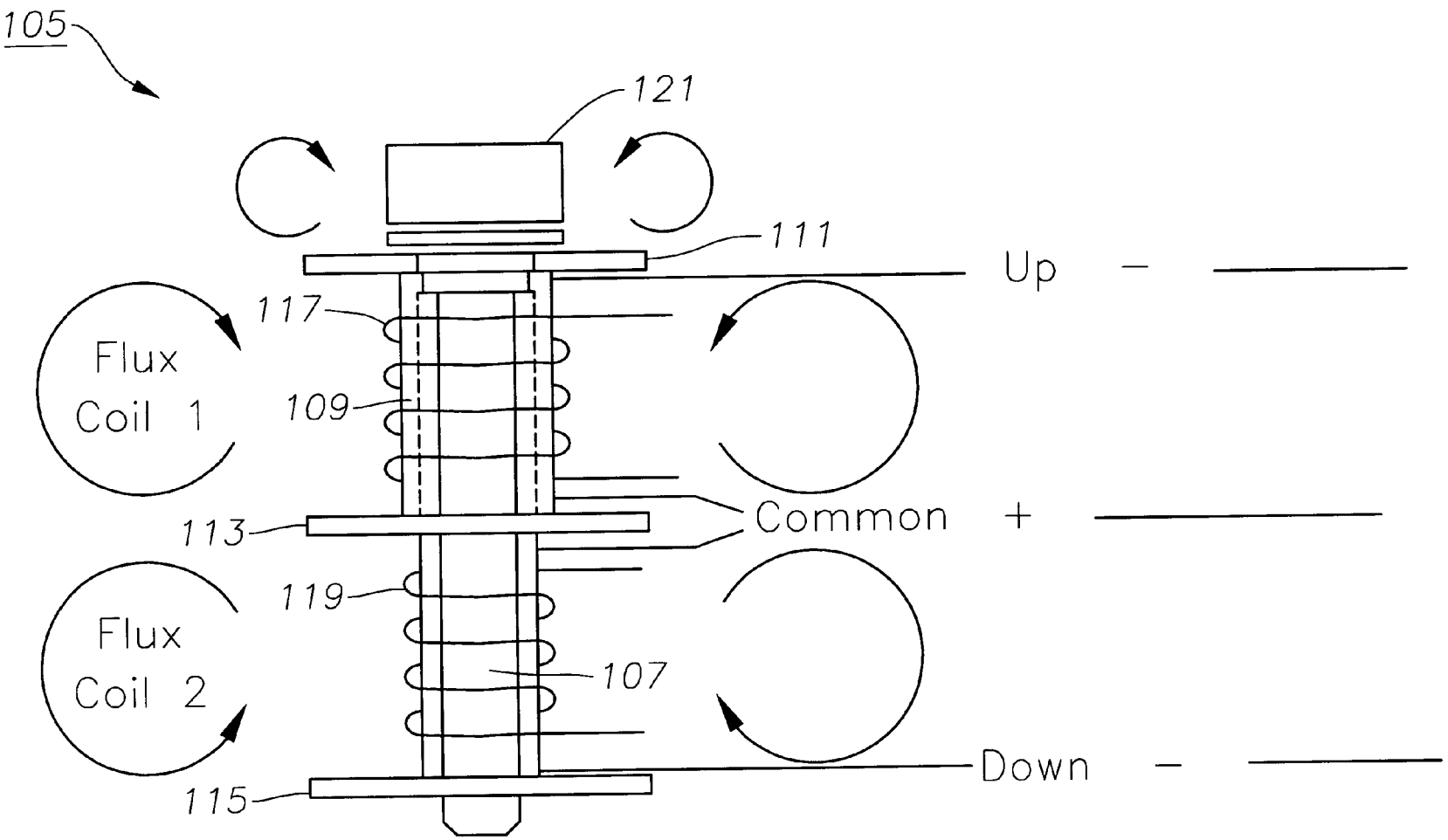

FIG. 13 is a schematic view of an alternate embodiment of the solenoid lock.

Figure 14:
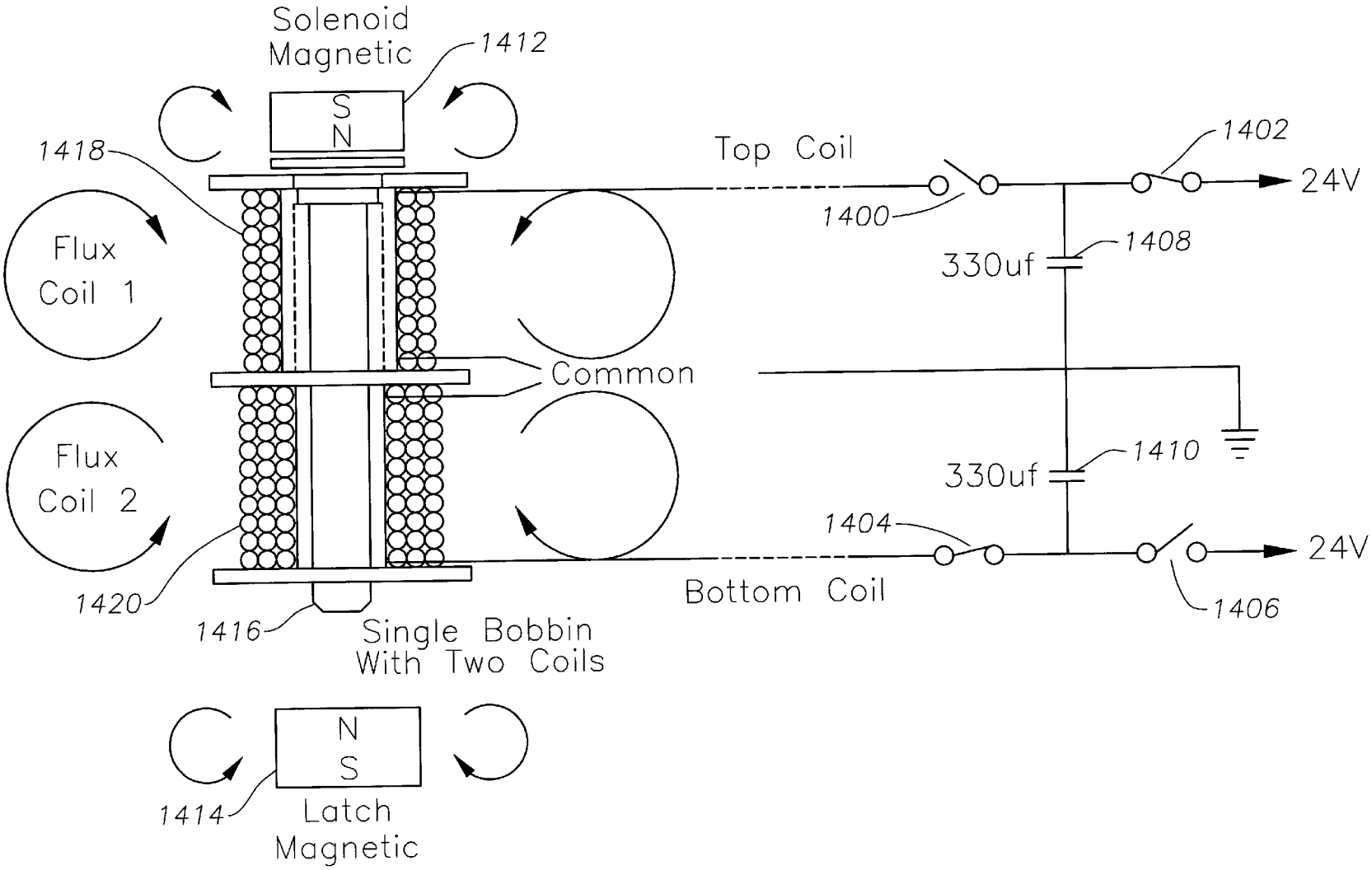

FIG. 14 is a schematic view of another alternate embodiment of the solenoid lock.

Figure 15:
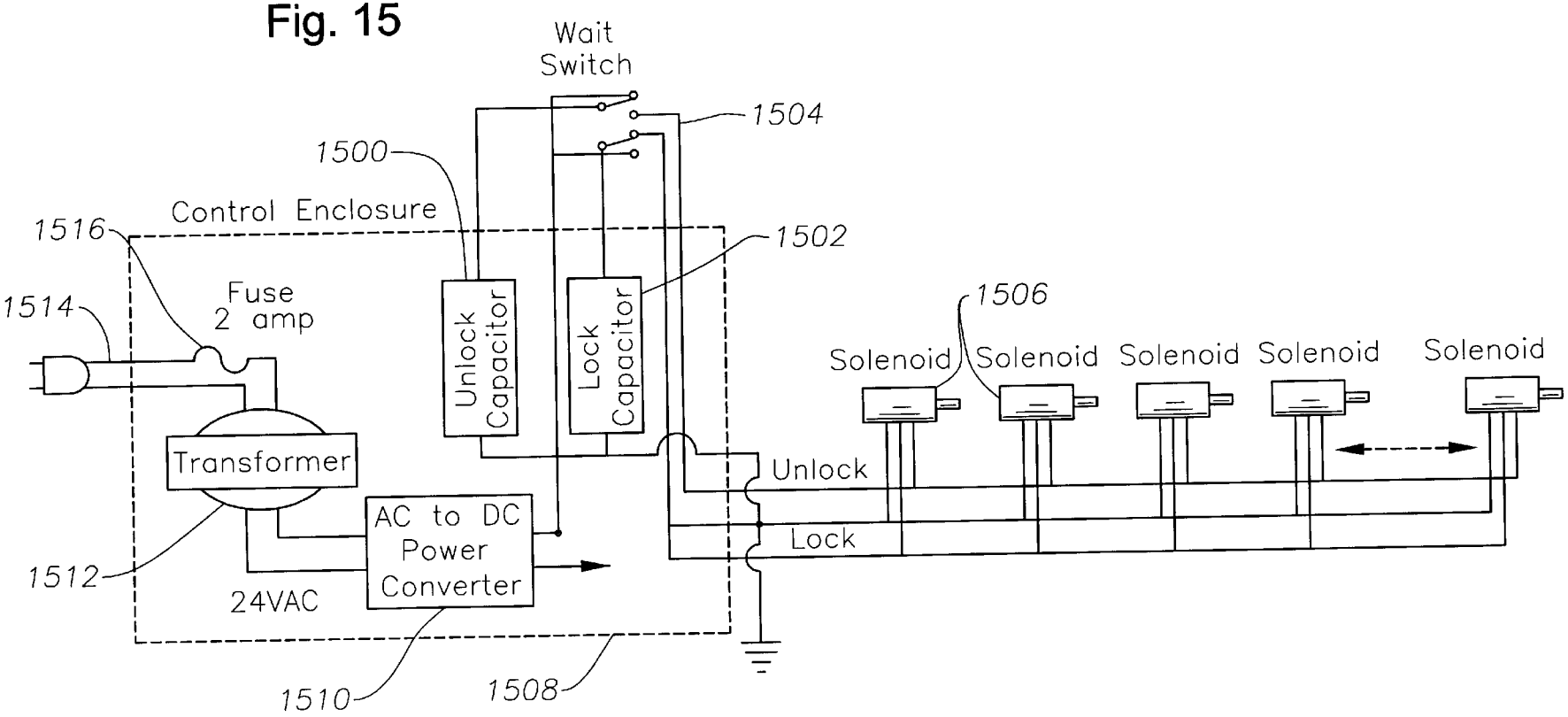

FIG. 15 is a schematic diagram of an embodiment of the invention that is connected to a convention 120 volt power supply rather than being battery operated.

Figure 16:
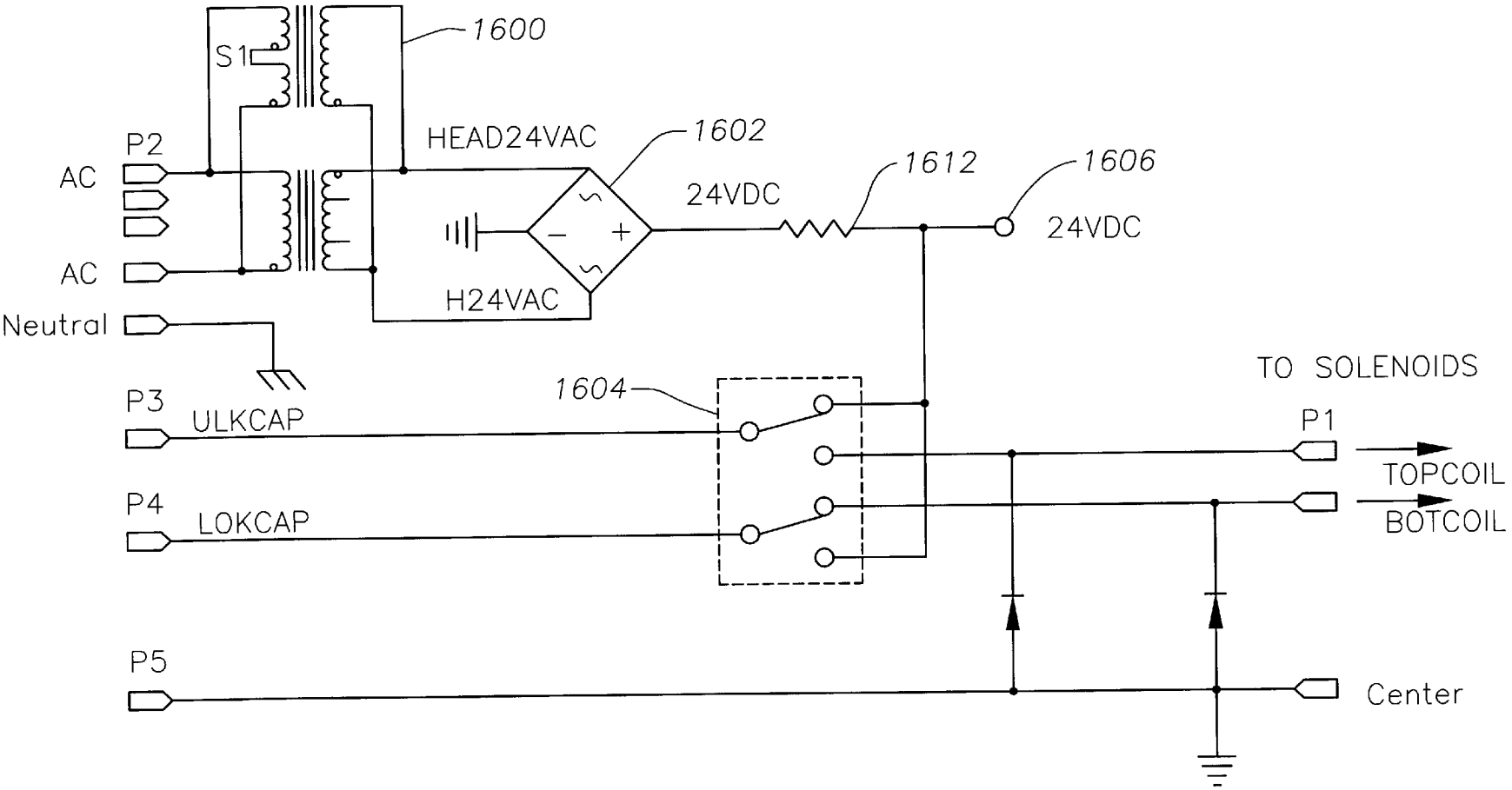

FIG. 16 is a circuit diagram of a portion of the preferred control circuit and wall switch relating to the FIG. 15 embodiment.

Figure 17:
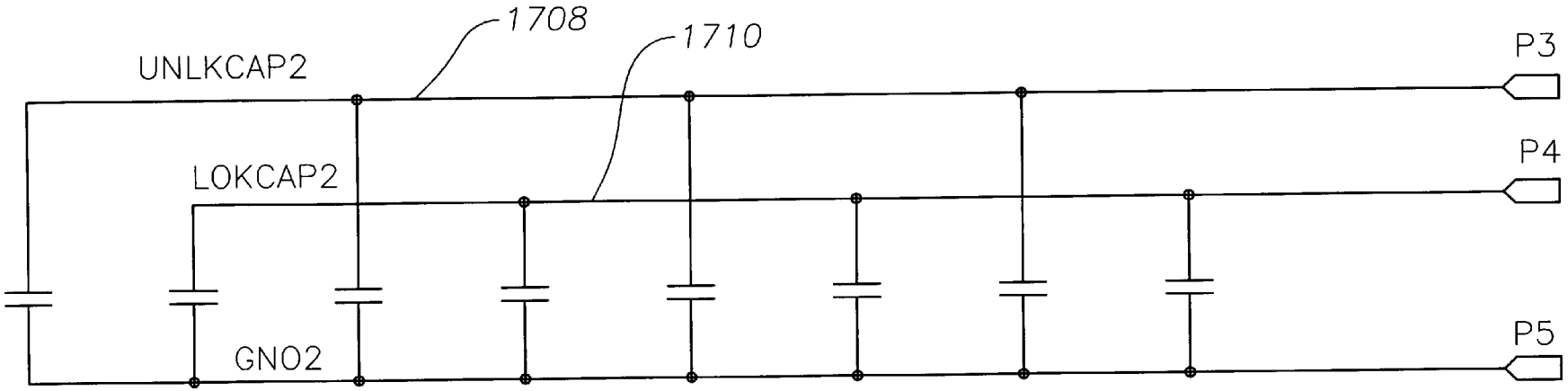

FIG. 17 is a circuit diagram of another portion of the preferred control circuit and wall switch relating to the FIG. 15 embodiment.

Figure 18:
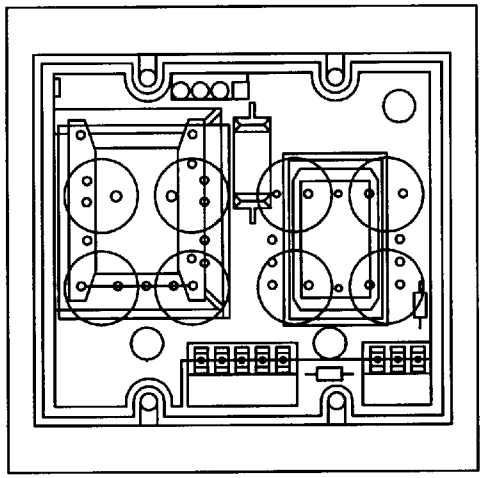

FIG. 18 is a preferred embodiment of components of the control circuitry and components shown in a form adapted to fit within a conventional utility box.

Figure 19:
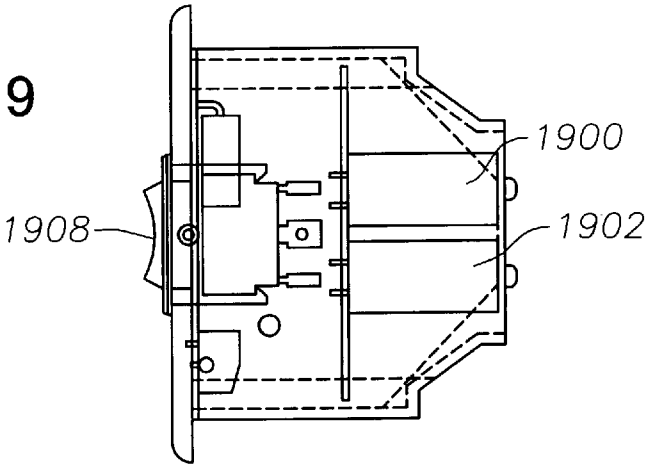

FIG. 19 is a side elevational view of the FIG. 18 embodiment.

Figure 20:
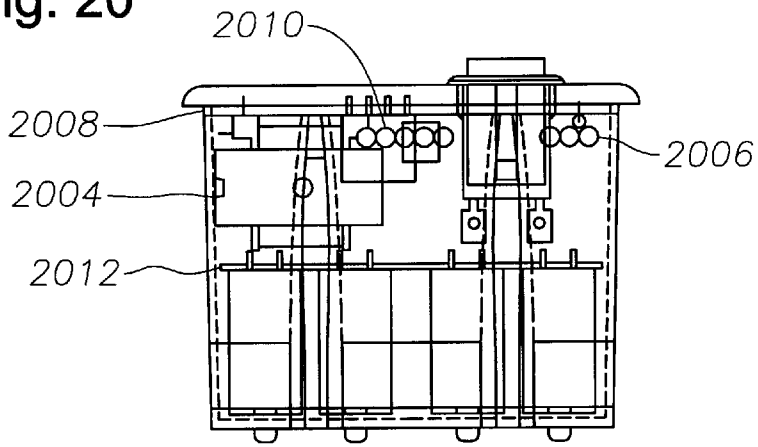

FIG. 20 is a bottom view of the FIG. 18 embodiment.

Figure 21:
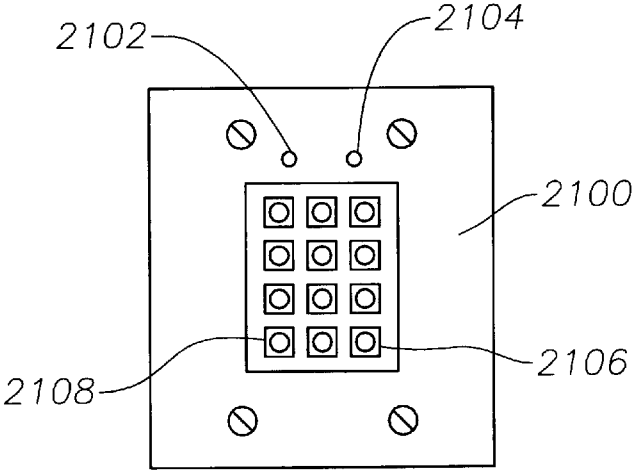

FIG. 21 illustrates a programmable key pad used in an alternate embodiment of the invention to provide a user defined encoded signal to activate pulses to the solenoid in each lock assembly.

Figure 22:
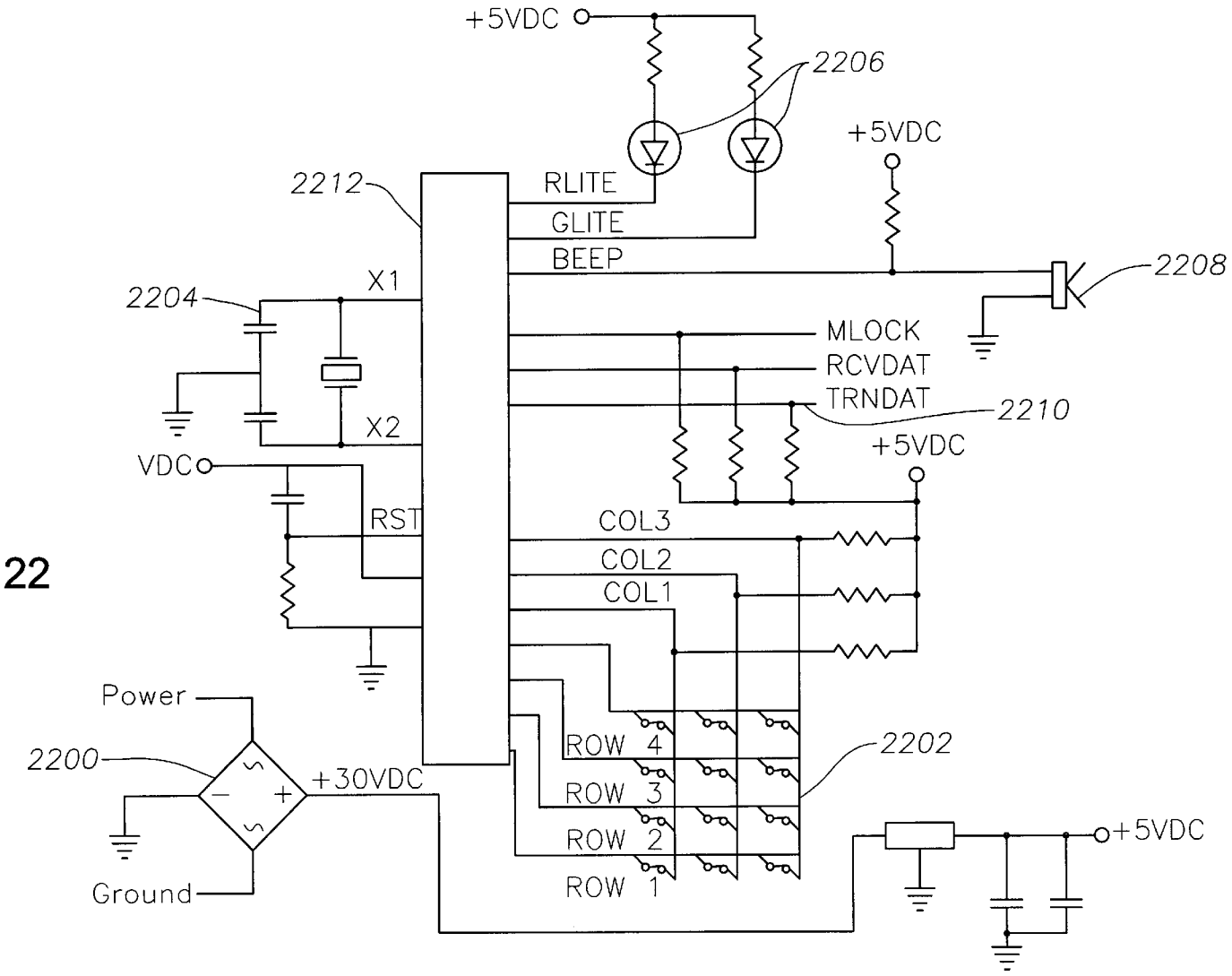

FIG. 22 is a circuit diagram of electronic control circuitry of the alternate embodiment that utilizes the key pad of FIG. 21.

Figure 23:
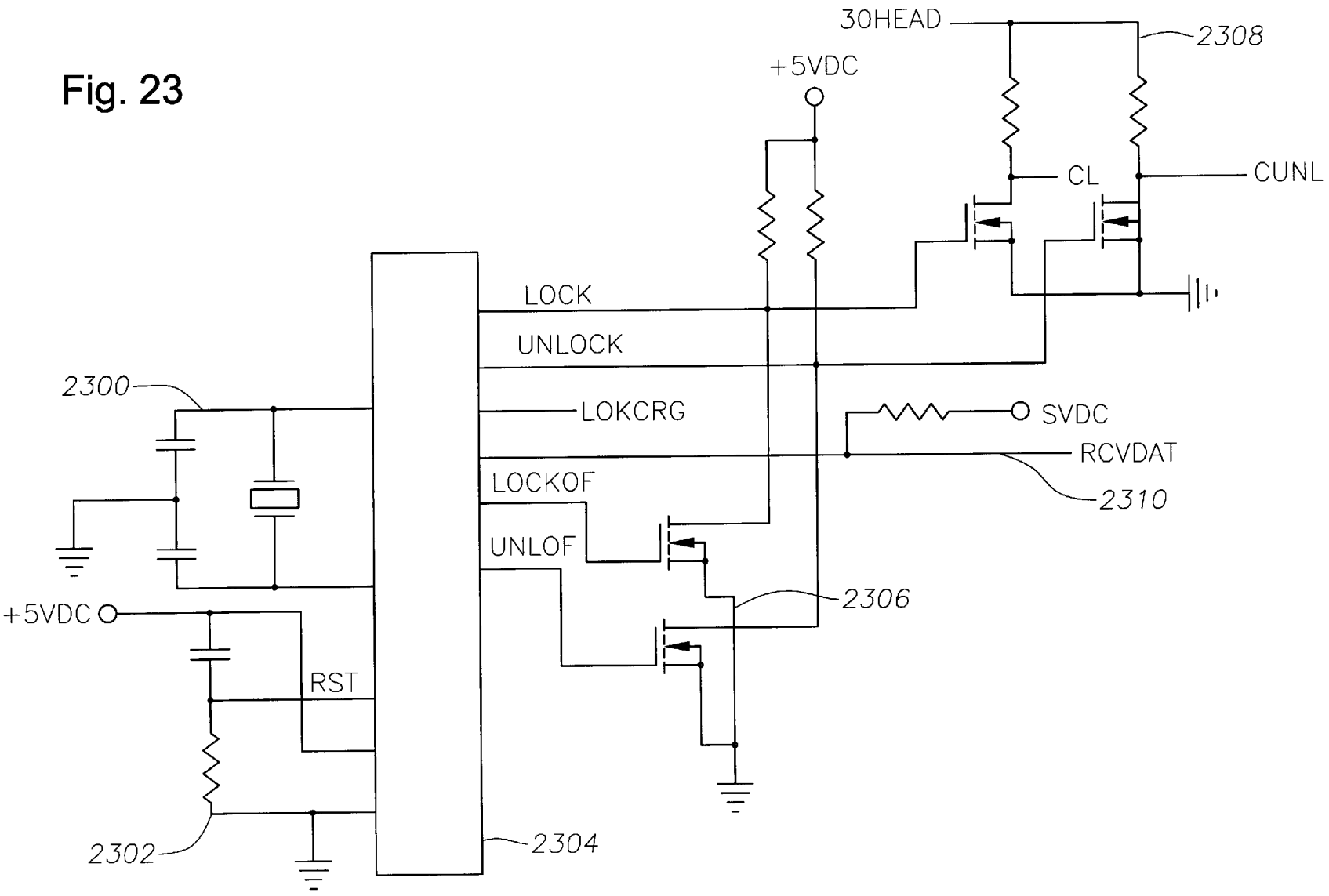

FIG. 23 is a circuit diagram of a power supply controller.

Figure 24:
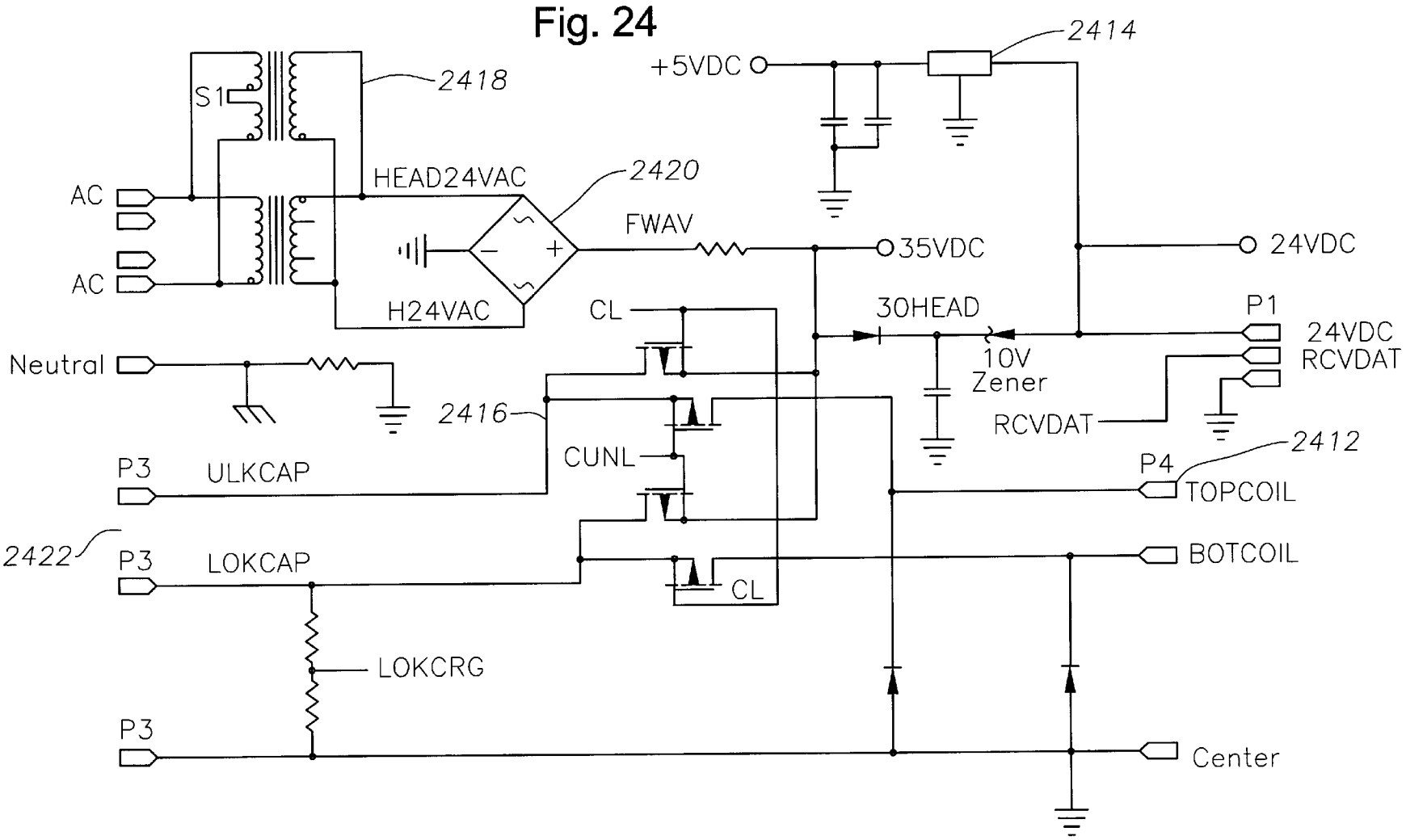

FIG. 24 is a circuit diagram of a portion of the power supply controller shown in FIG. 23.

Figure 25:
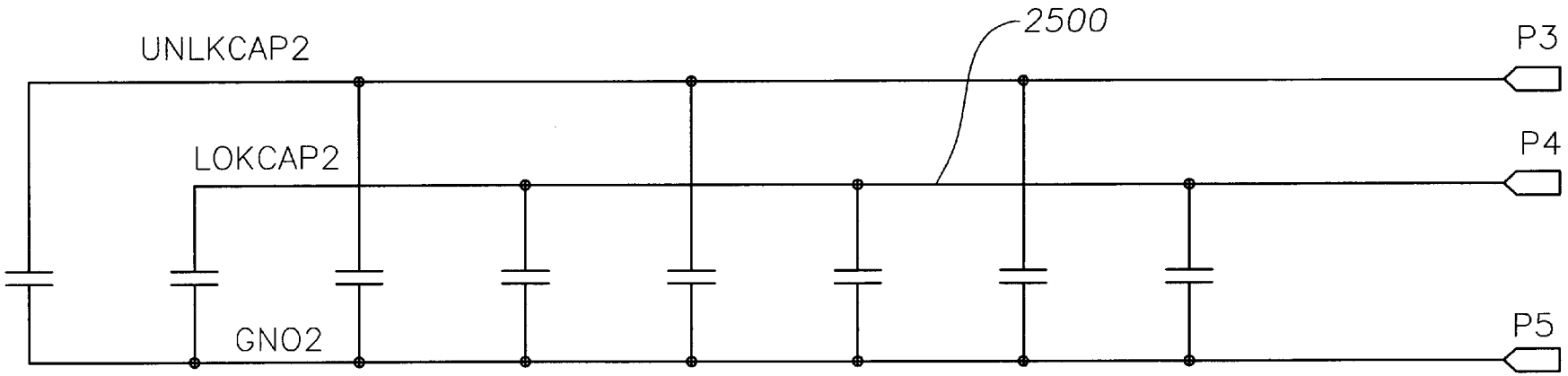

FIG. 25 is a circuit diagram of another portion of the power supply controller shown in FIG. 23.

Figure 26A:
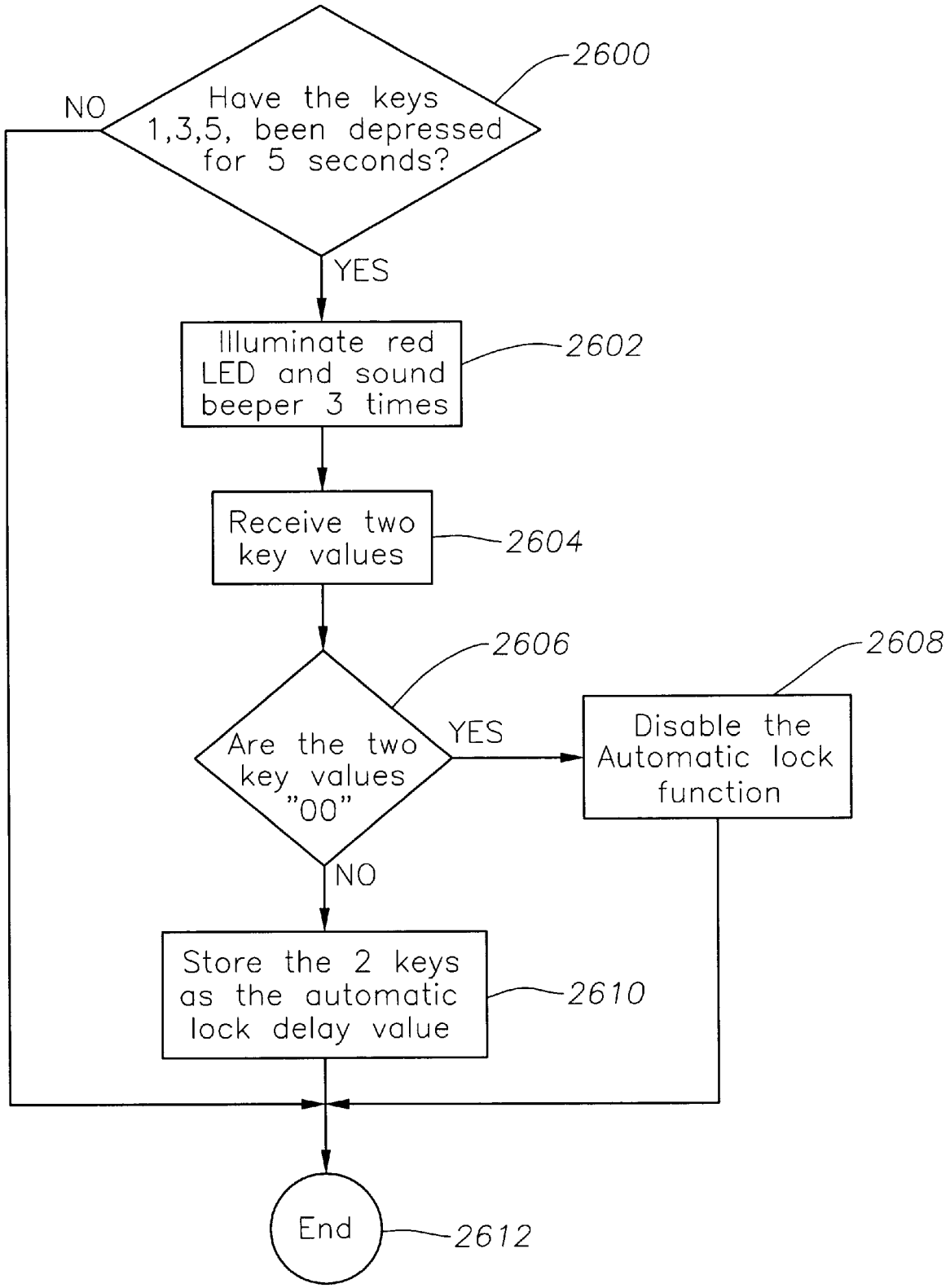

FIG. 26A depicts how to enable the automatic lock feature of the present invention.

Figure 26B:
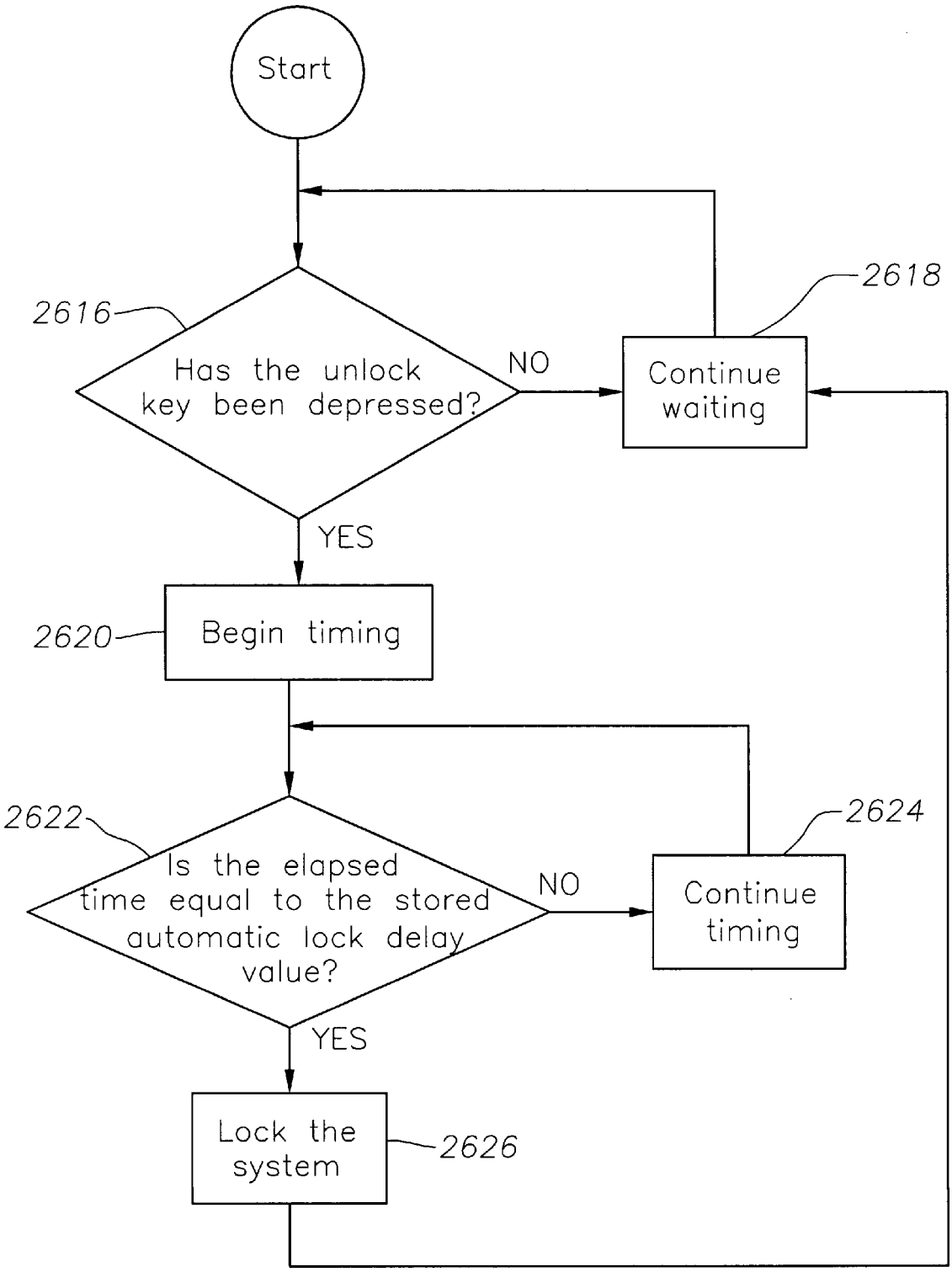

FIG. 26B illustrates how the automatic lock feature operates.

DETAILED DESCRIPTION OF THE INVENTION

Figure 1:
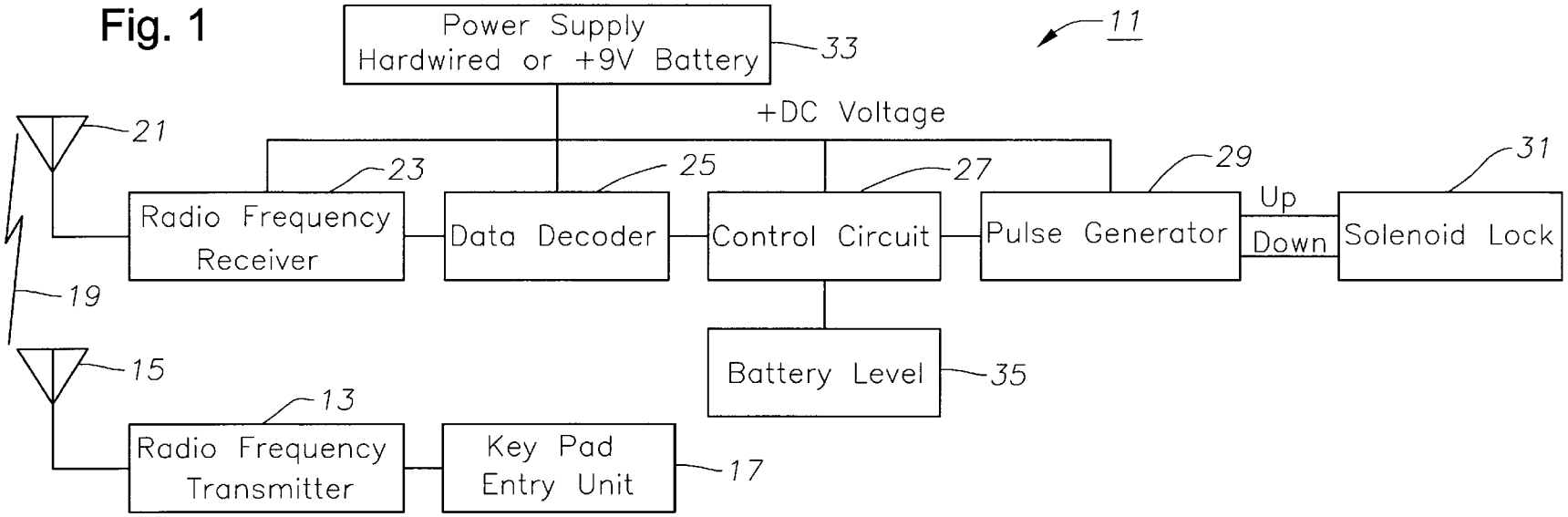
FIG. 1 is a schematic diagram of an electrical circuit for operating a remotely controlled solenoid lock according to the principles of our invention.

With reference now to the figures and in particular with reference to FIG. 1, the numeral 11 designates an electrical circuit that is remotely controlled by a radio frequency (RF), battery operated transmitter 13 of the same general type used to operate garage doors, using the same frequencies and signals that include encrypted codes that are selected by a key pad entry unit 17 through an antenna 15. The key pad entry unit 17 utilizes standard formats to send coded RF signals. Thus, the transmitter is adapted to send on command an encoded RF signal, represented by the line 19, to a receiver antenna 21 that is connected to an RF receiver 23, also of the conventional type used to operate garage doors. Such receivers include coding devices (not shown) to receive and be activated by the coded signals from the transmitter 13.

A data decoder 25 having two hundred fifty-six code combinations is connected with the RF receiver 23 to process the encoded signals sent by the transmitter 13 and, upon reception of the encoded signals, communicates with and activates a control circuit 27 contained in an integrated circuit chip. A pulse generator 29, connected with control circuit 27, sends selectively an "up" (unlock) or "down" (lock) signal to a solenoid lock 31.

The receiver circuit components described above are connected to a power supply 33, here either a nine volt replaceable battery, or alternately, nine volts from a transformer (not shown) connected to a one hundred ten volt alternating line current of an electric utility company. Each pulse width from the pulse generator 29 is between twenty and twenty-five milliseconds. Since the milliamp rating of the preferred 9V battery is approximately 450,000 milliamps, the maximum number of pulses would reach 18,000. It is estimated that normal usage will yield an average battery life between 500 and 700 days. A suitable battery is a "Duracell" 9V alkaline-manganese dioxide MN1604 type or equivalent. A battery voltage level detector 35 senses the voltage across the control circuit 27 and, if a selected low level is detected, communicates with the pulse generator 29 to send an "up" signal to the solenoid lock and disables further operation until voltage is restored.

Figure 3:
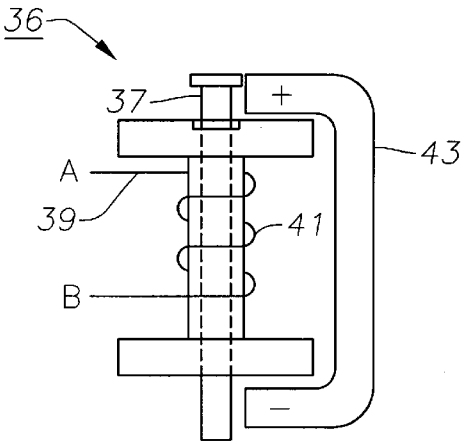
FIG. 3 is a schematic diagram of a portion of the solenoid lock, showing the coil, bobbin and permanent magnet associated with the H-bridge of FIG. 2.
Figure 2:
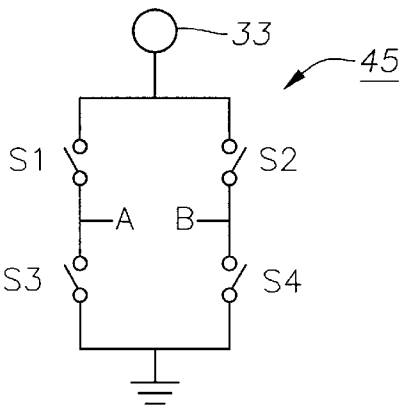
FIG. 2 is a schematic diagram of an H-bridge used to reverse polarity in an electrical coil of the solenoid lock of FIG. 1.

FIGS. 2 and 3 of the drawings illustrate schematically a single coil solenoid and operating circuit that controls the "up" (unlock) and "down" (lock) positions of a ferrous plunger 37. The plunger is cylindrical in form and reciprocally positioned within an electrically conductive coil 41, wound with an electrical conductor 39 having outputs or terminals A and B. The coil 41 is partially surrounded by a permanent magnet 43, all as shown in FIG. 3.

The H-bridge circuit 45 shown in FIG. 2 is connected to the power supply 33 and is a configuration of four switches S1, S2 and S3, S4 arranged in parallel configuration of series pairs S1, S3 and S2, S4 connected to the outputs A and B, which are the inputs A, B shown in FIG. 3. This configuration of switches allows the A, B outputs of FIG. 2 to be pulsed in either of two polarizations. The A, B outputs are the energy connections to the solenoid 36 of FIG. 3, which includes the ferrous plunger 37 that is reciprocally mounted in an axially extending opening in an electrically conductive coil 41. The electrically conductive coil 41 generates a strong magnetic field due to the close proximity of the permanent magnet 43. The H-bridge circuit configuration allows the solenoid to be pulsed in an A+ and B− or B+ and A− polarization. For example, by closing switches S1, S4, an A+ and B− polarization will be created. Conversely, with the S3, S2 switches open and the S1, S4 switches closed, a B+ and A− will be created.

FIG. 3 shows the plunger 37 suspended in an unlocked position through the magnetic force of the permanent magnet 43, with no current flow through the coil 41. By setting the switches of FIG. 2 in the B+ and A− configuration, the plunger 37 is displaced or urged in the "down" or lock position. Conversely, by setting the switches in the B− and A+ positions, the polarity reverses and the plunger 37 returns to the suspended, "up" or unlocked position. This single coil solenoid is an efficient means of actuating the plunger in the vertical position and contributes to long battery life. A double coil solenoid having reverse wound coils is an alternate embodiment that works well if the plunger is to be horizontally positioned but is less efficient since the magnetic flux is permeated through air.

The positions of the switches (S1, S2, S3, S4) shown in FIG. 2 is determined by remote control actuation, signaling either the locked or unlocked position.

Figure 4:
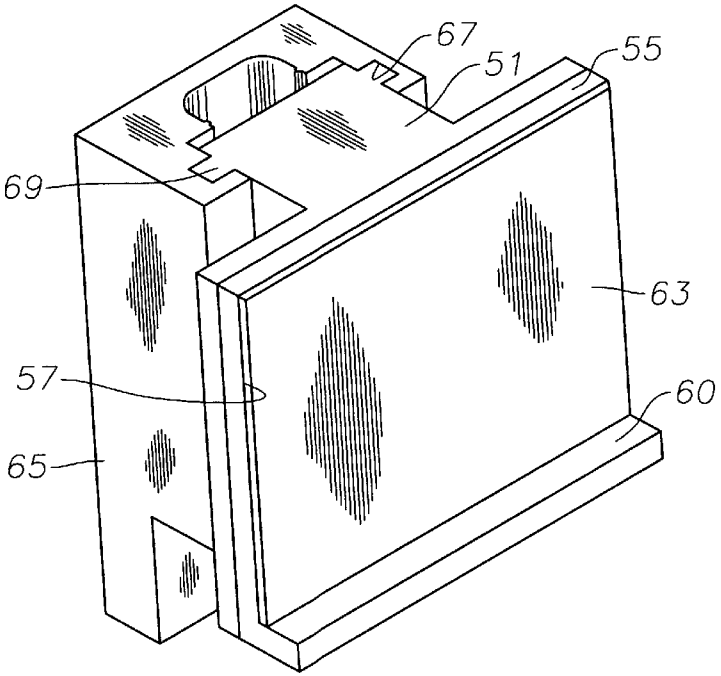
FIG. 4 is a perspective view of the main lock housing that contains the remotely controlled lock and electrical circuit.

The electrical circuit components of FIG. 1 are located within a housing 51 (see FIGS. 4, 8 and 12) adapted to mount within an enclosure header 53 (FIG. 12), over a cabinet of the type used in kitchens. The housing 51 has a mounting plate 55 with a flat surface 57 to fit flush against an inner wall 59 (see FIGS. 4 and 5) of the header 53. A transverse ridge 60 is adapted to abut the horizontal, lower surface 61 that defines the top of the opening to be closed by a cabinet door. A double backed adhesive tape 63 is adhered to the flat surface 57 of the housing to facilitate positioning and alignment during installation. An alignment rack 65 has grooves 67 to mate with rails 69 (FIG. 4). As shown in FIG. 5, the housing 51 and alignment rack 65 are positioned on the header 53, held in position by the adhesive tape 63 and then permanently secured with screws 70 (see FIG. 8) extending through a series of holes 71 in the mounting plate 55.

A series of side elevational views are shown in FIGS. 6, 7 and 8. With the circuit housing 51 and alignment rack 65 in the correct position on the inner surface 59 of the header 53, the latch mechanism 73 will be accurately positioned such that a detent 75 is aligned with the aperture 77 that extends through the bottom wall 79 of the circuit housing 51. The lower end of the plunger 37 shown in FIG. 3, must extend through the aperture 77 of the circuit housing 51 and into the detent 75 of the latch mechanism 73 to defined the "down" or lock position. The "up" or unlock position is achieved when the lower end of the plunger 37 is retracted from the detent 75 of the latch mechanism 73.

The preferred construction of the latch mechanism 73 is shown in FIGS. 9–11. This construction permits convenient alignment during installation of the detent 75 of the latch mechanism with the dead bolt plunger 37. Here, a latch holder base 80 has mounting holes 81 to receive screws 83 (FIG. 8) that permanently secures the latch mechanism 73 to the inner surface 85 of a cabinet door 87 shown in FIG. 8. The latch holder base 80 has a channel 89 with striations 91 of a saw-tooth configuration and a fastener slot 93. Oppositely facing saw-tooth striations 95 are formed on the exterior, side surfaces of a latch tongue 97 that contains a fastener hole 99 that will upon assembly align with the fastener slot 93 of the latch holder base 80. FIG. 10 shows the latch holder base 80 and the latch tongue 97 assembled. The saw tooth striations 91 of the holder and 95 of the tongue enable the tongue to be easily inserted into the holder and to then resist separation. After assembly is completed, the fastener 101 shown in FIG. 11 prevents movement of the tongue relative to the holder. Also shown in FIG. 11 is the cavity 120 for receiving a magnet for use with the solenoid mechanism. A double backed adhesive tape 103 is secured to the flat, rear surface of the latch holder base 80 to facilitate installation.

The assembly of the latch mechanism 73 is shown in FIGS. 6, 7 and 8. In FIG. 6 the latch mechanism is shown immediately before the tongue 97 is inserted within and aligned with the lower portion of the alignment rack 65. The door 87 is then closed (see FIG. 7) such that the inside surface 85 of the door engages latch holder base 80, forcing the striations 91 through the striations 95 of the latch tongue 97 (see FIG. 10). The latch holder base 80 and the latch tongue 97 are then secured together by tightening the fastener 101 shown in FIG. 11. The door 87 is then opened, the covering of the double backed tape 103 is peeled off and the door 87 closed. The latch holder base 80 is then adhered to the inside surface 85 of the cabinet door. The tongue 97 is inserted into the channel 89 of the latch holder base 80 until the aperture 77 of the circuit housing 51 is aligned with the detent 75 of the tongue 97. Now, with the striations maintaining the correct position of the holder and tongue, the fastener 101 is inserted into the slot 93 of the holder and into the hole 99 of the tongue and tightened. Fasteners 83 are inserted into the holes 81 of the latch holder base 80 and into the inner surface 85 of the cabinet door 87 and tightened.

The latch mechanism 73 can thus be positioned with respect to the circuit housing 51 on a wide variety of enclosures such as cabinets and desks by the use of a purchased kit that contains the above described components. An alternate embodiment solenoid lock 105 is shown schematically in FIG. 13, including a ferrous plunger 107 reciprocally wound in a spool 109 having three platens 111, 113, 115. Reverse wound electrical coils 117, 119 are selectively energized to form a magnetic field of polarity and then another in response to signals received from the previously described pulse generator. Thus, the ferrous plunger can be thrust to the lock position or the unlock position. A permanent magnet 121 holds the ferrous plunger in the up or unlocked position in the absence of any current flow, as when the power supply battery fails or falls to a low output.

With reference now to FIG. 14, there is shown a schematic view of another alternate embodiment of a solenoid lock. The arrangement of switches 1400, 1402, 1404, and 1406 illustrates how they can alternately charge and discharge capacitors 1408 and 1410. In the present view, switches 1402 and 1404 are shown in the closed position, while switches 1400 and 1406 are shown open. Switches 1400 and 1406 will always open and close together as will switches 1402 and 1404. This type of action can be realized in a double-throw, double-pole switch.

The above-mentioned switches alternately discharge capacitors 1408 and 1410 through coils 1418 and 1420. While capacitor 1410 is discharging through coil 1420, capacitor 1408 will be charging to 24 volts DC. Likewise, when capacitor 1408 is discharging through coil 1418, capacitor 1410 will be charging to this same 24-volt DC signal. When switches 1400–1406 are switched from one position to another, either capacitor 1408 or 1410 will discharge, depending on the original position of switches 1400–1406. The discharge of capacitors 1408 and 1410 through coils 1418 and 1420 alternately moves plunger 1416 from one position to another.

When current begins to flow through coil 1420, two separate forces start to act on plunger 1416. First, there is a solenoid force. This force is characterized by the tendency of a ferrous body placed in the center of an energized coil to move toward the center of that coil. Next, a magnetic force is exerted on plunger 1416 by magnets 1412 and 1414. This magnetic force occurs because when the coil surrounding plunger 1416 becomes energized, plunger 1416 temporarily becomes a magnet itself.

Thus, when coil 1420 becomes energized, the solenoid force of coil 1420 acting on plunger 1416 tends to drive the plunger downward. Also, coil 1420 has been wound so that when energized, plunger 1416 temporarily becomes magnetized so that the upper portion of plunger 1416 is the north pole of the magnet created by the magnetic field emanating from coil 1420. The situation then exists where the north pole of magnet 1412 is in contact with the north pole of plunger 1416. The resulting magnetic force tends to move plunger 1416 away from magnet 1412. This repulsive magnetic force, combined with the solenoid force exerted by coil 1420 drives plunger 1416 downward. The downward movement of plunger 1416 is enhanced by magnet 1414. As plunger 1416 draws closer to magnet 1414, the southern pole of plunger 1416 is attracted to the northern pole of magnet 1414, thereby creating an attractive force which further enhances the movement of plunger 1416 downward.

In a similar manner, when plunger 1416 is in a down position, coil 1418 can be energized to move plunger 1416 upward into contact with magnet 1412. When coil 1418 is energized, plunger 1416 becomes magnetized, with its northern pole facing downward. When this pole is created, plunger 1416 is repelled from magnet 1414, resulting in an upward movement. Also, the solenoid force created by coil 1420 will work with the magnetic force to move plunger 1416 upward. It should be noted that one could reverse the polarity of all of the magnetic elements described above and the functionality of the solenoid lock shown in FIG. 14 would not change.

In the preferred embodiment, magnets 1412 and 1414 are included in the switch arrangement shown in FIG. 14. However, satisfactory results can be obtained from using only magnet 1412, especially when plunger 1416 is in the horizontal position. Also, magnets 1414 and 1412 are provided to secure plunger 1416 in place once coils 1420 and 1418 have shifted its position. In addition, in the preferred embodiment, coils 1418 and 1420 are comprised of 33 gauge wire, turned 1000 times. Magnets 1412 and 1414 are ¼ inch in diameter with a thickness of ⅛ inch. Also, magnets 1412 and 1414 are magnetized axially. Plunger 1416 weighs approximately ½ ounce and is ⅞ inch long and has a diameter of 3⁄16 inch.

With reference now to FIG. 15, there is depicted a schematic which shows the major features of a hard wired lock system. Plug 1514 transmits 120 VAC to transformer 1512. There, the 120 VAC signal is stepped down to 24 VAC. This 24 VAC signal is subsequently converted to 24 VDC by converter 1510. Fuse 1516 protects the entire system from an oversupply of current.

Double pole double throw switch 1504 is connected so that in one position, lock capacitor bank 1502 is discharged across the lock coils of solenoids 1506 and unlock capacitor bank 1500 is charged to the output of converter 1510. When switch 1504 is in the other position, unlock capacitor bank 1500 is discharged across the unlock coils of solenoids 1506 and lock capacitor bank 1502 is charged to the output of convertor 1510. The arrangement of the elements in FIG. 15 allows solenoids 1506 to be actuated by switch 1504 when switch is 1504 switched from one position to another. Also, this arrangement allows for no power to be present in the connecting wires to solenoids 1506, except during the actual lock and unlock operations.

Another advantage of the circuit as shown in FIG. 15 is demonstrated in the event of a power loss. Since capacitors are used to lock and unlock the system, one capacitor bank will always be charged when power is cut to the system. This allows for one additional lock or unlock operation after power has been removed from the system, as one capacitor bank will still retain a charge.

With respect now to FIGS. 16 and 17, there is illustrated a more detailed view of some of the elements shown in FIG. 15. Transformer 1600 receives as input 120 VAC, and steps this voltage down to 24 VAC. Converter 1602 transforms the 24 VAC output of transformer 1600 into a 24 VDC signal. Resistor 1612 is placed in series with the output of converter 1602 in order to protect converter 1602 from the effects of discharging and charging the capacitors through the coils of the solenoids.

The output of converter 1602 is transmitted to unlock capacitor bank 1708 and lock capacitor bank 1710 through switch 1604. Switch 1604 alternately charges one set of capacitors, while discharging the other set of capacitors through the coils of the solenoids.

Now with respect to FIGS. 18–20, there is illustrated three views of the physical packaging of the elements found in FIGS. 15–17. The housing which contains these elements is designed to fit in a standard 4-gange (a.k.a. 2-plex) utility box.

Lock capacitor bank 1902 and unlock capacitor bank 1900 are disposed behind transformer 2004 and switch 1908. Output connector 2006 carries power to the coils of the solenoids. The 110 VAC input power is received through connector 2010. Besides capacitors 1900 and 1902, circuit board 2008 contains transformer 2004 and the other the electrical components shown in FIGS. 15–17. Capacitors 1900 and 1902 are contained on circuit board 2012.

With reference now to FIG. 21, there is illustrated an alternate embodiment of a portion of the present invention. In FIGS. 15–17, a switch was used to activate the solenoids that locked and unlocked the system. In FIG. 21, key pad 2100 is provided to require a user to enter a 4-digit code to activate the key pad. Once key pad 2100 has been activated, green LED 2102 will be illuminated. This 4-digit security code is programmed into the internal memory of the key pad system and is checked any time a group of 4 digits is entered through key pad 2100. If the 4 digits that are entered via key pad 2100 are equal to the 4-digit security code stored in the system's memory, the unit will beep once and enable "LOCK" button 2108 and "UNLOCK" button 2106 found at the bottom of key pad 2100. Once enabled, the system may be operated using only "LOCK" button 2108 and "UNLOCK" button 2106. Any time a number is entered that does not compare with the security code in memory, the key pad beeps once and disables "LOCK" button 2108 and "UNLOCK" button 2106.

By operating in such a manner, the key pad system is protected in either a lock state or unlock state. Also, by responding in the same manner for a correct entry as for an incorrect one, the key pad system makes guessing the correct code more difficult. If more than 10 seconds elapse between digit entries, or if less than 4 digits are entered, the key pad system will reset itself and will continue waiting for the first digit of a new code to be entered.

A new 4-digit security code may be entered into the key pad system via key pad 2100 by pressing the keys 2, 7, and 9 for 5 seconds. When programming mode is entered, the key pad system will beep 3 times and red LED 2104 will be illuminated continuously. Next, the user enters a new 4-digit security code. If more than 10 seconds elapse between digit entries, or if less than 4 digits are entered, the system will exit programming mode.

When the key pad system loses power, the system will power up in a disabled state, and the security code will be 1-3-7-9. This code was chosen because a pattern is easier to remember than an arbitrary number.

Key pad 2100 may also be programmed to automatically send a lock signal if, after a user specified amount of time, there has been no activity received from the key pad. As depicted in FIG. 26A, this function is enabled by depressing the keys 1, 3, and 5 for five seconds (2600). The system will respond by illuminating the red LED and by sounding the beeper for three seconds (2602). Next, the user enters a two-digit number that corresponds to the number of minutes the key pad should wait before locking the system (2604). If the value of the two keys pressed equals "00" (2606), the system will disable the automatic lock function (2608). However, if the two keys pressed are not "00", the system will store the value as the number of minutes to wait after the unlock key has been pressed before automatically locking the system (2610). After receiving any two key values, the key pad will automatically exit programming mode (2612).

The operation of the automatic lock function is illustrated in FIG. 26B. Once this function is enabled, the key pad waits for the unlock key to be depressed (2616, 2618). Once the unlock key is depressed (2616), the key pad starts a timer (2620). When the number of minutes elapsed equals the two digit value previously programmed (2622, 2624), the key pad automatically locks the system (2626). After the system is locked, the process returns to waiting for the unlock key to be pressed.

With respect now to FIG. 22, there is depicted the circuit diagram for the security key pad shown in FIG. 21. Processor 2212 is provided to receive information from key pad 2202 and to communicate information to other parts of the system. In a preferred embodiment of the present invention, processor 2212 is a Phillips 38C750 microprocessor and is run at a clock rate of 3.6864 MHz. Processor 2212 is connected to key pad 2202 and beeper 2108 through its input/output ports. Key pad 2202 is read by processor 2212 ten times a second. The switches of key pad 2202 are debounced with three reads by processor 2212. Beeper 2208 is used to indicate the mode of key pad 2202. One beep after 4 digits have been entered indicates the code entry mode. Three beeps when the 1, 3, and 0 keys are depressed for five seconds indicates the system is in programming mode and waiting for a new 4-digit code.

As the keys on key pad 2202 are depressed for more than 3 scan times, processor 2212 transforms the key being pressed into a digit. After processor 2212 receives 4 digits, the security code previously stored is compared with the 4 digits that have just been received. If the entered code matches the stored code, "LOCK" button 2108 and "UNLOCK" button 2106, as shown in FIG. 21, become active. Once these buttons are active, a user may press these buttons to lock and unlock the solenoids.

The key pad circuitry depicted in FIG. 22 locks and unlocks the solenoids by transmitting lock and unlock messages to a power supply controller not shown in this figure. These messages are sent to the power supply controller via communication lines 2210. Communication lines 2210 may be connected to a maximum of three power supply controller units. A lock signal is sent to a power supply controller by transmitting the 4 byte ASCII string "LOCK". This signal is transmitted at 300 bits per second. An unlock signal consists of the 4 byte ASCII string "UNLK". The red LED will blink when a signal is sent to the controller.

LEDs 2206 are used to indicate whether a valid 4 digit code has been received by processor 2212. The red LED will be lit when the key pad is an programming mode, and the green LED will be lit when the key pad is active.

Clock circuitry 2204 is connected to processor 2212 in order to supply a clock signal. Also, power supply circuitry 2200 is used to supply processor 2212 and other components in FIG. 22 with a 5 VDC signal.

With reference now to FIGS. 23, 24, and 25, there is depicted a circuit diagram of a power supply controller. Processor 2304 operates to receive lock and unlock messages from a security key pad unit and to activate the circuitry which locks and unlocks the solenoids. Processor 2304 is connected to power supply circuitry 2302 and to clock source circuitry 2300.

Upon power-up, the lock and unlock functions of processor 2304 are disabled. The lock and unlock switch drivers for processor 2304 are switches 2308. These switches are controlled by port 0, pin 6 and 7 of processor 2304. Before initialization is complete, port 1, pin 16 and 17 disables switches 2304.

The determination of whether to power-up the system in a locked or unlocked condition is made by first sampling the charge of the lock capacitor bank on port 1, pin 7. If the input to port 1, pin 7 of processor 2304 is high, the system was powered-down with the lock capacitor bank charging and the unlock capacitor bank discharging. If this is the case, port 0, pin 7 is set low and port 0, pin 6 is set high. This action switches the lock capacitor bank to charge and the unlock capacitor bank to discharge. Thus, the system resumes operation in the same state it was in when power was interrupted. Once processor 2304 has finished this initialization routine, port 0, pin 6 will be the inverse of port 0, pin 7, and port 1, pins 16 and 17 will be low, thereby enabling switches 2304.

Once the initialization is complete, processor 2304 changes state from lock to unlock or unlock to lock when processor 2304 decodes a message from input line 2310 to either lock or unlock the system. The 4 byte ASCII message "LOCK" will cause processor 2304 to activate its lock signal, while the 4 byte ASCII message "UNLK" will cause processor 2304 to activate its unlock signal. Communications line 2310 transmits lock and unlock signal from the key pad system to the power supply controller.

As stated above, processor 2304 will activate its lock or unlock signals when it receives the appropriate data from the key pad system on communication line 2310. When processor 2304 receives either a "LOCK" or "UNLK" message, processor 2304 will respond with a pulsed output to the solenoid locks. The lock and unlock signals from switch drivers 2308 are received by switches 2416. These switches are configured so that when they receive a signal to lock, they can switch capacitors 2500 to send a pulsed output to the solenoid locks to lock them. Likewise, when switches 2416 receive an unlock signal from switch drivers 2308, they can switch capacitors 2500 so that the solenoid locks receive an unlock signal on signal lines 2412.

Also shown in FIG. 24 is transformer 2418 which steps down an AC wall voltage to 24 VAC. This 24 VAC signal is received by converter 2420, which converts the 24 V AC signal to a 24 VDC signal. A portion of this 24 VDC signal is routed through regulator 2414, which converts the 24 VDC signal to 5 VDC.

While the invention has been described in only three of its forms, it is not thus limited, but is susceptible to various changes and modifications without departing from the spirit thereof.

What is claimed is:

1. A locking system for a compartment having an interior surface and a movable closure for sealing an opening in the wall of the compartment, comprising:

a latch adapted to be mounted on the closure;

a ferrous plunger adapted to be mounted on the interior surface of the compartment for movement between a locked position wherein the plunger is received by the latch, and an unlocked position wherein the plunger disengages the latch;

an electrically conductive first coil surrounding a first portion of the plunger;

an electrically conductive second coil surrounding a second portion of the plunger and wound in an opposite direction to the first coil;

a lock actuating device located apart from and for manipulating the plunger; the lock actuating device comprising:

a first capacitor connected to the first coil;

a second capacitor connected to the second coil; and a switching device adapted to be connected to a voltage source and connected to the capacitors and the coils, having a first position wherein the second capacitor is charged and the first capacitor is discharged to transmit a pulse of energy to the first coil for creating a magnetic field in a first direction to move the plunger to the unlocked position, and a second position wherein the first capacitor is charged and the second capacitor is discharged to transmit a pulse of energy to the second coil for creating a magnetic field in a second direction to move the plunger to the locked position.

2. The locking system of claim 1 further comprising: a first member positioned near a first end of the plunger for engaging and maintaining the plunger in one of the positions after the pulse has been sent to one of the coils and prior to sending a pulse to the other of the coils.

3. The locking system of claim 2 wherein the first member is a first magnet.

4. The locking system of claim 2, further comprising a second member positioned near a second end of the plunger for maintaining the plunger in the other of the positions after the pulse has been sent to the other of the coils.

5. The locking system of claim 4 wherein the first and second members are magnets.

6. The locking system of claim 1 wherein:

the first and second coils have first and second power leads, respectively, and common ground leads for connection to a ground, each of the power leads having terminals adapted to be connected to the voltage source; wherein the first and second capacitors have ground legs adapted to be connected to the ground and power legs connected to the first and second power leads, respectively, and wherein the switching device comprises:

first and second switches, connected into the first and second power leads, respectively, between the terminals and the first and second capacitors, respectively, the first switch being closed while the second switch is open and vice versa; and third and fourth switches, connected between the power legs of the first and second capacitors, respectively, and the first and second coils, respectively, the third switch being open while the fourth switch and first switch are closed and vice versa.

7. The locking system of claim 6 wherein the switches of the switching device move in unison.

8. The locking system of claim 1 wherein the latch has a hole which receives the plunger.

9. In a cabinet having an interior surface and a hinged door for sealing an opening in the cabinet, a locking system comprising:

a latch mounted on the door;

a ferrous plunger mounted on the interior surface of the cabinet for movement between a locked position wherein the plunger is received by the latch, and an unlocked position wherein the plunger disengages the latch;

an electrically conductive first coil surrounding a portion of the plunger;

a first power lead connected to the first coil and a voltage source;

an electrically conductive second coil surrounding a portion of the plunger adjacent to the first coil and wound in an opposite direction to the first coil;

a second power lead connected to the second coil and the voltage source, the first and second coils being oppositely wound and connected to a common ground;

a lock actuating device located remotely from and for manipulating the plunger; the lock actuating device comprising:

a first capacitor having a ground leg connected to the ground and a power leg connected to the first power lead;

a second capacitor having a ground leg connected to the ground and a power leg connected to the second power lead;

a switching device, comprising:

first and second switches, connected into the first and second power leads, respectively, between terminals and the first and second capacitors, respectively, the first switch being closed while the second switch is open and vice versa; and third and fourth switches, connected between the power legs of the first and second capacitors, respectively, and the first and second coils, respectively, the third switch being open while the fourth switch and first switch are closed; and the switching device having a first position wherein the second capacitor is charged and the first capacitor is discharged to transmit a pulse of energy to the first coil for creating a magnetic field to move the plunger to the unlocked position, and a second position wherein the first capacitor is charged and the second capacitor is discharged to transmit a pulse of energy to the second coil for creating a magnetic field to move the plunger from the unlocked position to the locked position.

10. The locking system of claim 9 further comprising: a first member positioned near a first end of the plunger for engaging and maintaining the plunger in one of the positions after the pulse has been sent to one of the coils and prior to sending a pulse to the other of the coils.

11. The locking system of claim 10, further comprising a second member positioned near a second end of the plunger for maintaining the plunger in the other of the positions.

12. The locking system of claim 11 wherein the first and second members are magnets.

13. The locking system of claim 10 wherein the latch has a hole which receives the plunger while the plunger is in the locked position.

14. The locking system of claim 9 wherein the switches of the switching device move in unison.

* * * * *